US012590702B2

(12) United States Patent
Badhuk et al.

(10) Patent No.: US 12,590,702 B2
(45) Date of Patent: Mar. 31, 2026

(54) GAS TURBINE ENGINE COMBUSTOR WITH A SET OF DILUTION PASSAGES

(71) Applicant: GENERAL ELECTRIC COMPANY, Schenectady, NY (US)

(72) Inventors: Pabitra Badhuk, Bengaluru (IN); Michael T. Bucaro, Arvada, CO (US); Pradeep Naik, Bengaluru (IN); Perumallu Vukanti, Bengaluru (IN); Arijit Sinha Roy, Bangalore (IN); Sibtosh Pal, Mason, OH (US); Bhavya Naidu Panduri, Bengaluru (IN); Aritra Chakraborty, Bengaluru (IN); Ajoy Patra, Bengaluru (IN); R Narasimha Chiranthan, Bengaluru (IN); Michael A. Benjamin, West Chester, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 30 days.

(21) Appl. No.: 18/104,433

(22) Filed: Feb. 1, 2023

(65) Prior Publication Data

US 2024/0200777 A1 Jun. 20, 2024

(30) Foreign Application Priority Data

Dec. 20, 2022 (IN) ..... 202211073864

(51) Int. Cl.
*F23R 3/06* (2006.01)

(52) U.S. Cl.
CPC ..... *F23R 3/06* (2013.01); *F23R 2900/03041* (2013.01)

(58) Field of Classification Search
CPC .... F23R 3/06; F23R 3/04; F23R 3/002; F23R 2900/03041–03045; F23R 2900/00045; F23R 3/10–14
See application file for complete search history.

(56) References Cited

U.S. PATENT DOCUMENTS

| | | | | |
|---|---|---|---|---|
| 3,077,073 A | | 2/1963 | Kuhrt | |
| 4,062,182 A | | 12/1977 | Fehler et al. | |
| 4,262,486 A | | 4/1981 | Russell | |
| 4,689,961 A | * | 9/1987 | Stratton | F23R 3/14 60/746 |
| 5,307,637 A | * | 5/1994 | Stickles | F23R 3/002 60/757 |
| 5,331,805 A | | 7/1994 | Myers et al. | |

(Continued)

FOREIGN PATENT DOCUMENTS

| | | |
|---|---|---|
| CA | 2939125 A1 | 3/2017 |
| EP | 2206964 A3 | 5/2012 |

(Continued)

*Primary Examiner* — Stephanie Sebasco Cheng
(74) *Attorney, Agent, or Firm* — Carter, DeLuca & Farrell LLP

(57) ABSTRACT

A combustor comprising a dome wall, an annular liner, a combustion chamber, a set of fuel cups, and a set of dilution passages for each fuel cup of the set of fuel cups. The set of fuel cups circumferentially spaced along the dome wall relative to the combustor centerline. The set of dilution passages terminating in a plurality of slots spaced about the corresponding fuel cup in the set of fuel cups.

17 Claims, 17 Drawing Sheets

(56) References Cited

U.S. PATENT DOCUMENTS

| | | | | |
|---|---|---|---|---|
| 5,497,611 | A * | 3/1996 | Benz | F23R 3/02 60/776 |
| 7,681,398 | B2 | 3/2010 | Patel et al. | |
| 8,109,099 | B2 | 2/2012 | Tu et al. | |
| 8,365,536 | B2 | 2/2013 | Khan et al. | |
| 8,387,397 | B2 | 3/2013 | Chen et al. | |
| 8,424,311 | B2 | 4/2013 | York et al. | |
| 8,590,312 | B2 | 11/2013 | Sandelis | |
| 9,103,547 | B2 | 8/2015 | Eroglu et al. | |
| 9,534,790 | B2 | 1/2017 | Cai et al. | |
| 9,557,060 | B2 | 1/2017 | Papple et al. | |
| 9,840,924 | B2 | 12/2017 | Hase et al. | |
| 9,976,743 | B2 | 5/2018 | Propheter-Hinckley et al. | |
| 10,072,846 | B2 | 9/2018 | Monahan et al. | |
| 10,088,159 | B2 | 10/2018 | Erbas-Sen et al. | |
| 10,107,496 | B2 | 10/2018 | Rathmann et al. | |
| 10,132,500 | B2 | 11/2018 | Ryon et al. | |
| 10,208,958 | B2 | 2/2019 | Carroni et al. | |
| 10,408,453 | B2 | 9/2019 | Mongillo et al. | |
| 10,408,457 | B2 | 9/2019 | Akiyama et al. | |
| 10,488,046 | B2 * | 11/2019 | Low | F23R 3/50 |
| 10,648,666 | B2 | 5/2020 | Bouldin et al. | |
| 10,731,861 | B2 | 8/2020 | Schlein | |
| 10,844,791 | B2 | 11/2020 | Olsen et al. | |
| 11,029,027 | B2 | 6/2021 | Lewis et al. | |
| 11,073,284 | B2 | 7/2021 | Sandoval | |
| 2003/0167772 | A1 * | 9/2003 | Farmer | F23R 3/06 60/754 |
| 2003/0182943 | A1 | 10/2003 | Gerendas et al. | |
| 2006/0042263 | A1 * | 3/2006 | Patel | F23R 3/12 60/776 |
| 2007/0089417 | A1 * | 4/2007 | Khanna | F23C 13/06 60/723 |
| 2009/0188256 | A1 | 7/2009 | Woodcock et al. | |
| 2011/0056205 | A1 | 3/2011 | Carroni et al. | |
| 2013/0042627 | A1 * | 2/2013 | Gerendas | F23M 20/005 60/725 |
| 2016/0201918 | A1 | 7/2016 | Jella et al. | |
| 2016/0223200 | A1 * | 8/2016 | Singh | F23R 3/045 |
| 2017/0276356 | A1 * | 9/2017 | Mulcaire | F23R 3/002 |
| 2017/0350598 | A1 * | 12/2017 | Boardman | F23R 3/14 |
| 2018/0266324 | A1 * | 9/2018 | Lao | F02C 7/24 |
| 2019/0162414 | A1 | 5/2019 | Ogata et al. | |
| 2019/0249875 | A1 | 8/2019 | Gandikota | |
| 2020/0158342 | A1 | 5/2020 | Boardman et al. | |
| 2021/0247069 | A1 | 8/2021 | Iwai et al. | |
| 2021/0396388 | A1 | 12/2021 | Mongillo, Jr. et al. | |

FOREIGN PATENT DOCUMENTS

| | | | |
|---|---|---|---|
| EP | 2685170 | A1 | 1/2014 |
| EP | 2902708 | B1 | 2/2017 |
| EP | 2407720 | B1 | 10/2019 |
| EP | 2959229 | B1 | 10/2020 |
| EP | 3431875 | B1 | 12/2020 |
| GB | 2429516 | B | 12/2010 |
| GB | 2581385 | B1 | 8/2020 |

* cited by examiner

200

GAS TURBINE ENGINE COMBUSTOR WITH A SET OF DILUTION PASSAGES

CROSS-REFERENCE TO RELATED APPLICATION(S)

This application claims priority to Indian Patent Application No. 202211073864, filed Dec. 20, 2022, which is incorporated herein by reference its entirety.

TECHNICAL FIELD

The present subject matter relates generally to a gas turbine engine combustor with a set of dilution passages, more specifically to a combustor having a set of dilution passages located in a dome wall.

BACKGROUND

Gas turbine engines are driven by a flow of combustion gases passing through the engine to rotate a multitude of turbine blades. A combustor can be provided within the gas turbine engine and is fluidly coupled with a turbine into which the combusted gases flow.

Hydrocarbon fuels are commonly used in the combustor of a gas turbine engine. Generally, air and fuel are fed separately to the combustor, until they are mixed, and the mixture is combusted to produce hot combustion gas. The combustion gas is then fed to a turbine where it rotates the turbine to produce power. By-products of the hydrocarbon fuel combustion typically include nitrogen oxide and nitrogen dioxide (collectively called NOx), carbon monoxide (CO), unburned hydrocarbon (UHC) (e.g., methane and volatile organic compounds that contribute to the formation of atmospheric ozone), and other oxides, including oxides of sulfur (e.g., $SO_2$ and $SO_3$).

DETAILED DESCRIPTION

Figure 1:
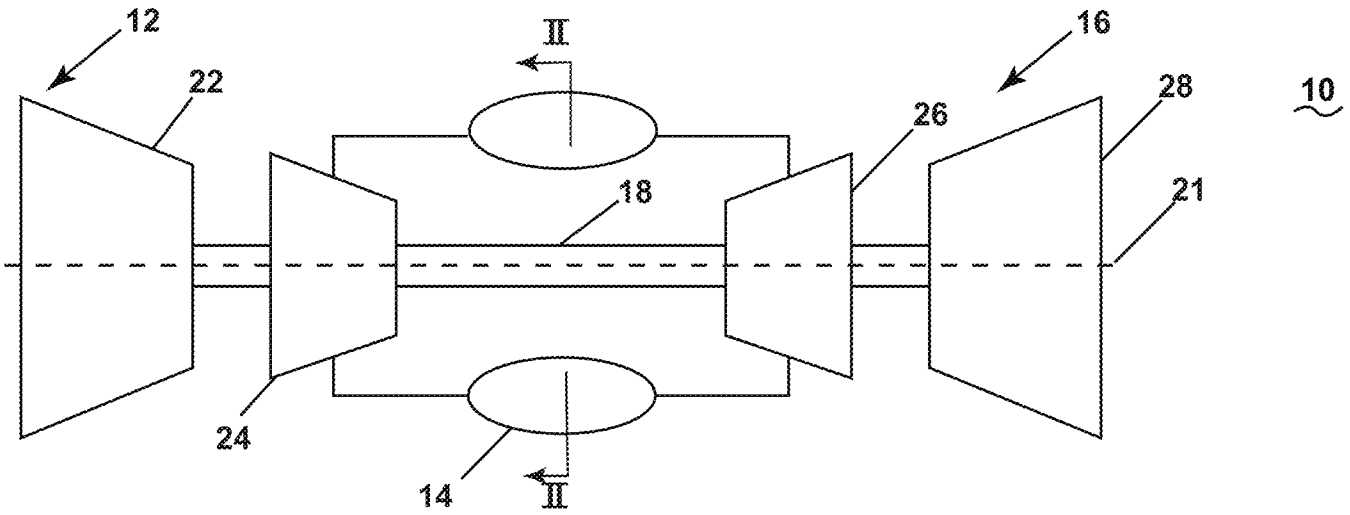
FIG. 1 is a schematic of a gas turbine engine.

Aspects of the disclosure described herein are directed to a combustor. The combustor includes a combustion chamber at least partially defined by a dome wall. A set of fuel cups are annularly arranged on the dome wall and fluidly coupled to the combustion chamber. A dilution passage arrangement is provided around each fuel cup of the set of fuel cups. The dilution passage arrangement of each fuel cup can be selected to function with adjacent fuel cups and their corresponding dilution passage arranged to collectively control the annular flame spread from all of the fuel cups as well as individually controlling the flame spread from each fuel cup. Each dilution passage arrangement includes a set of dilution passages terminating in a plurality of slots provided along the dome wall. As described herein, a single "dilution passage arrangement" refers to a plurality of slots provided around a single, corresponding fuel cup of the set of fuel cups. It will be appreciated that there can be any number of dilution passage arrangements. For example, the total number of dilution passage arrangements can correspond to the total number of fuel cups of the set of fuel cups.

For purposes of illustration, the present disclosure will be described with respect to a gas turbine engine. It will be understood, however, that aspects of the disclosure described herein are not so limited and that a combustor as described herein can be implemented in engines, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first", "second", and "third" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

Additionally, as used herein, the terms "radial" or "radially" refer to a direction away from a common center. For example, in the overall context of a gas turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

Approximating language, as used herein throughout the specification and claims, is applied to modify any quantitative representation that could permissibly vary without resulting in a change in the basic function to which it is related. Accordingly, a value modified by a term or terms, such as "about", "approximately", "generally", and "substantially", are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

FIG. 1 is a schematic view of a gas turbine engine 10. As a non-limiting example, the gas turbine engine 10 can be used within an aircraft. The gas turbine engine 10 can include, at least, a compressor section 12, a combustion section 14, and a turbine section 16 in serial flow arrangement. A drive shaft 18 rotationally couples the compressor and turbine sections 12, 16, such that rotation of one affects the rotation of the other, and defines a rotational axis or engine centerline 21 for the gas turbine engine 10.

The compressor section 12 can include a low-pressure (LP) compressor 22, and a high-pressure (HP) compressor 24 serially fluidly coupled to one another. The turbine section 16 can include an LP turbine 26, and an HP turbine 28 serially fluidly coupled to one another. The drive shaft 18 can operatively couple the LP compressor 22, the HP compressor 24, the LP turbine 26 and the HP turbine 28 together. Alternatively, the drive shaft 18 can include an LP drive shaft (not illustrated) and an HP drive shaft (not illustrated). The LP drive shaft can couple the LP compressor 22 to the LP turbine 26, and the HP drive shaft can couple the HP compressor 24 to the HP turbine 28. An LP spool can be defined as the combination of the LP compressor 22, the LP turbine 26, and the LP drive shaft such that the rotation of the LP turbine 26 can apply a driving force to the LP drive shaft, which in turn can rotate the LP compressor 22. An HP spool can be defined as the combination of the HP compressor 24, the HP turbine 28, and the HP drive shaft such that the rotation of the HP turbine 28 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the gas turbine engine 10. It will be appreciated that the representation of the compressor section 12 is merely schematic and that there can be any number of stages. Further, it is contemplated, that there can be any other number of components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 28 at a downstream end of the combustion section 14.

During operation of the gas turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 28, which drives the HP compressor 24. The combustion gases are discharged into the LP turbine 26, which extracts additional work to drive the LP compressor 22, and the exhaust gas is ultimately discharged from the gas turbine engine 10 via an exhaust section (not illustrated) downstream of the turbine section 16. The driving of the LP turbine 26 drives the LP spool to rotate the fan (not illustrated) and the LP compressor 22. The pressurized airflow and the combustion gases can together define a working airflow that flows through the fan, compressor section 12, combustion section 14, and turbine section 16 of the gas turbine engine 10.

Figure 2:
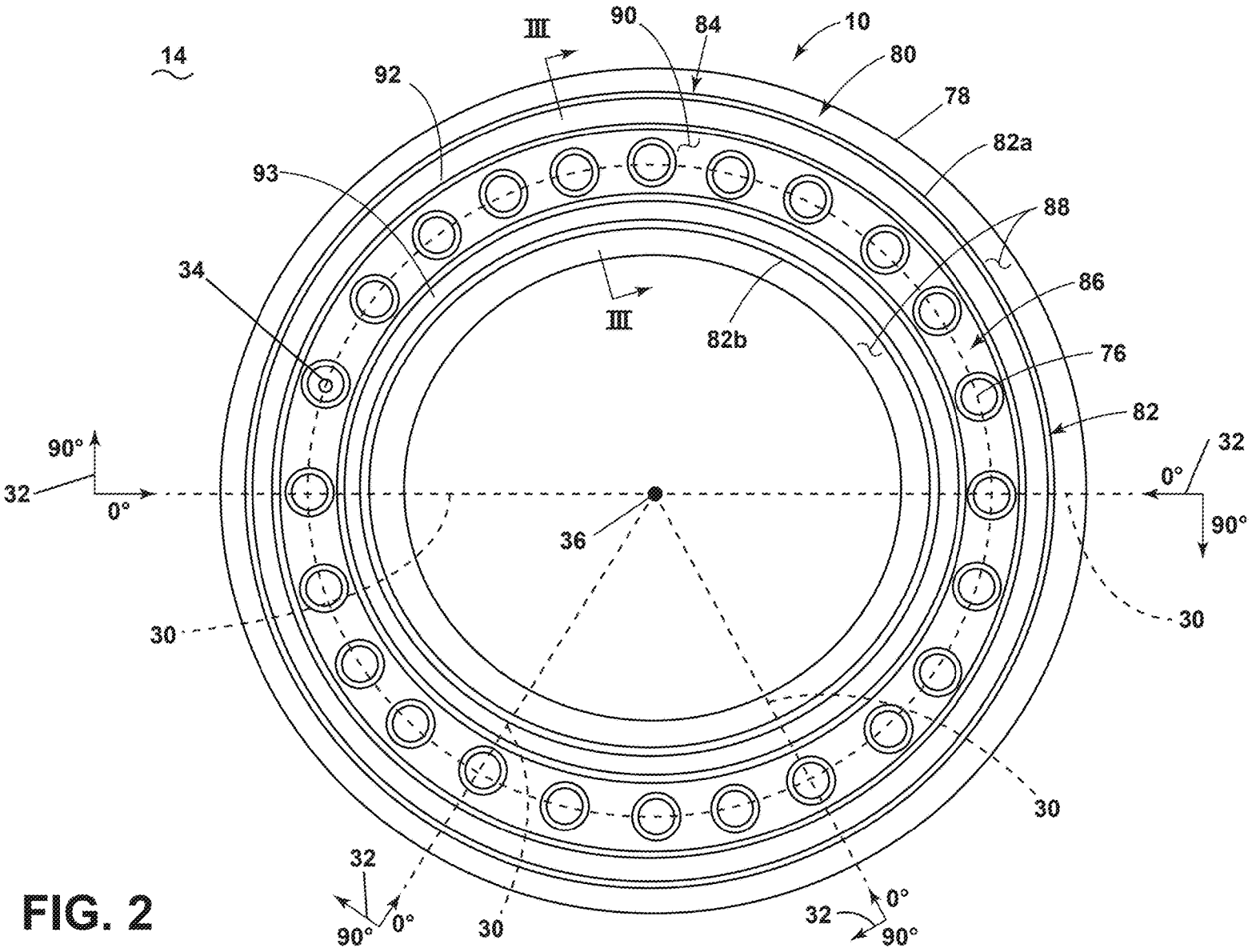
FIG. 2 depicts a cross-section view along line II-II of FIG. 1 of a combustion section of the gas turbine engine.

FIG. 2 depicts a cross-section view of the combustion section 14 along line II-II of FIG. 1. The combustion section 14 can include an set of fuel cups 76 disposed around a combustor centerline 36. The combustor centerline 29 can be the centerline 21 of the turbine engine 10. The combustor centerline 36 can be a centerline for the combustion section 14, a single combustor, or a set of combustors that are arranged about the combustor centerline 36.

The combustor 80 can have a can, can-annular, or annular arrangement depending on the type of engine in which the combustor 80 is located. In a non-limiting example, an annular arrangement is illustrated and disposed within a casing 78. The combustor 80 is defined by a combustor liner 82 including an outer annular combustor liner 82*a* and an inner annular combustor liner 82*b* concentric with respect to each other and annular about the combustor centerline 36. A dome assembly 84 including a dome wall 90 together with the combustor liner 82 can define a combustion chamber 86 annular about the combustor centerline 36. At least one fuel cup 76, illustrated as multiple fuel injectors annularly arranged about the combustor centerline 36, is fluidly coupled to the combustion chamber 86. A compressed air passageway 88 can be defined at least in part by both the combustor liner 82 and the casing 78.

The at least one fuel cup 76 is included within a plurality of fuel cups 76. Each fuel cup 76 can include a fuel cup centerline 34 that extends into the page. Each fuel cup centerline 34 can be arranged along a circumferential line 70. Alternatively, one or more fuel cups 76 can be offset from the circumferential line 70. Additionally, the fuel cups 76 can be arranged such that the fuel cup centerlines 34 form a pattern relative to, but not necessarily on, the circumferential line 70.

Each fuel cup centerline 34 in combination with the combustor centerline 36, can be used to define a respective fuel cup reference line 30 that extends radially from the combustor centerline 36 and through the corresponding fuel cup centerline 34. For the purposes of illustration, four fuel cup reference lines 30 are shown, however, it will be appreciated that each fuel cup 76 includes a fuel cup reference line 30. The fuel cup reference line 30 is used in this description to establish a local polar coordinate system 32 for each fuel cup 76. The local polar coordinate system defines a 0-180 degree line lying on the corresponding reference line 30, and a 90-270 degree line for each of the four illustrated fuel cup reference lines 30. The 0 degree and 90 degree lines have been shown for convenience on each of the polar coordinate systems 32. Since the fuel cups 76 are circumferentially spaced around the combustor centerline 36, a polar coordinate system based on the fuel cup reference line 30 is a convenient way to describe the local fuel cups 76, while taking into account the rotational shifts in the local coordinate system due to the circumferential arrangement.

Figure 3:
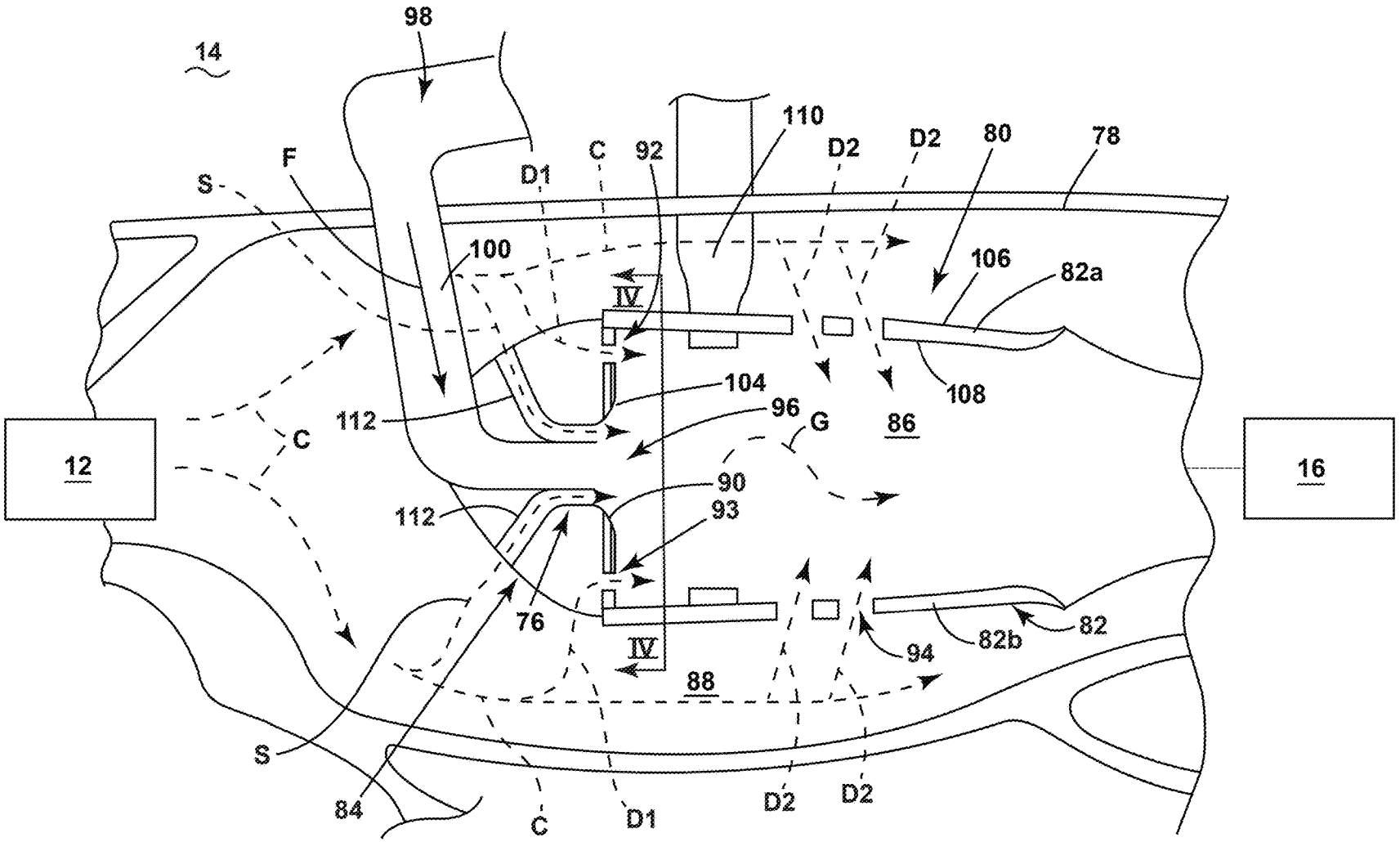
FIG. 3 is a schematic of a side cross-sectional view taken along line III-III of FIG. 2 of a combustor in the combustion section formed from a combustor liner having multiple sets of dilution passages according to an aspect of the disclosure herein.

FIG. 3 depicts a cross-section view taken along line III-III of FIG. 2 illustrating the combustion section 14. A first set of dilution passages 92, a second set of dilution passages 93 and a third set of dilution passages 94 can fluidly connect the compressed air passageway 88 and the combustor 80.

The fuel cup 76 can be coupled to and disposed within the dome assembly 84. The fuel cup 76 can include a flare cone 104 and a swirler 112. The flare cone 104 includes an outlet 96 of the fuel cup 76 directly fluidly coupled to the combustion chamber 86. The fuel cup 76 is fluidly coupled to a fuel inlet 98 via a linear passageway 100.

Both the inner and outer combustor liners 82*a*, 82*b* can have an outer surface 106 and an inner surface 108 at least partially defining the combustion chamber 86. The combustor liner 82 can be made of one continuous monolithic portion or be multiple monolithic portions assembled together to define the inner and outer combustor liners 82*a*, 82*b*. By way of non-limiting example, the outer surface 106 can define a first piece of the combustor liner 82 while the inner surface 108 can define a second piece of the combustor liner 82 that when assembled together form the combustor liner 82. As described herein, the combustor liner 82 includes the third set of dilution passages 94. It is further contemplated that the combustor liner 82 can be any type of combustor liner 82, including but not limited to a single wall or a double walled liner or a tile liner. An ignitor 110 can be provided at the combustor liner 82 and fluidly coupled to the combustion chamber 86, at any location, by way of non-limiting example upstream of the third set of dilution passages 94.

During operation, a compressed air (C) can flow from the compressor section 12 to the combustor 80 through the dome assembly 84. The compressed air (C) is fed to the fuel cup 76 via the swirler 112 as a swirled airflow (S). A flow of fuel (F) is fed to the fuel cup 76 via the fuel inlet 98 and the linear passageway 100. The swirled airflow (S) and the flow of fuel (F) are mixed at the flare cone 104 and fed to the combustion chamber 86 as a fuel/air mixture. The ignitor 110 can ignite the fuel/air mixture to define a flame within the combustion chamber 86, which generates a combustion gas (G). While shown as starting axially downstream of the outlet 96, it will be appreciated that the fuel/air mixture can be ignited at or near the outlet 96.

The compressed air (C) is further fed to dilution passages 92, 93 as a first dilution airflow (D1) and to the third set of dilution passages 94 as a second dilution airflow (D2). The first dilution airflow (D1) is used to direct and shape the flame, while the second dilution airflow (D2) is used to direct the combustion gas (G).

The combustor 80 shown in FIG. 3 is well suited for the use of a hydrogen-containing gas as the fuel because it helps contain the faster moving flame front associated with hydrogen fuel, as compared to traditional hydrocarbon fuels. However, the combustor 80 can be used with traditional hydrocarbon fuels.

Figure 4:
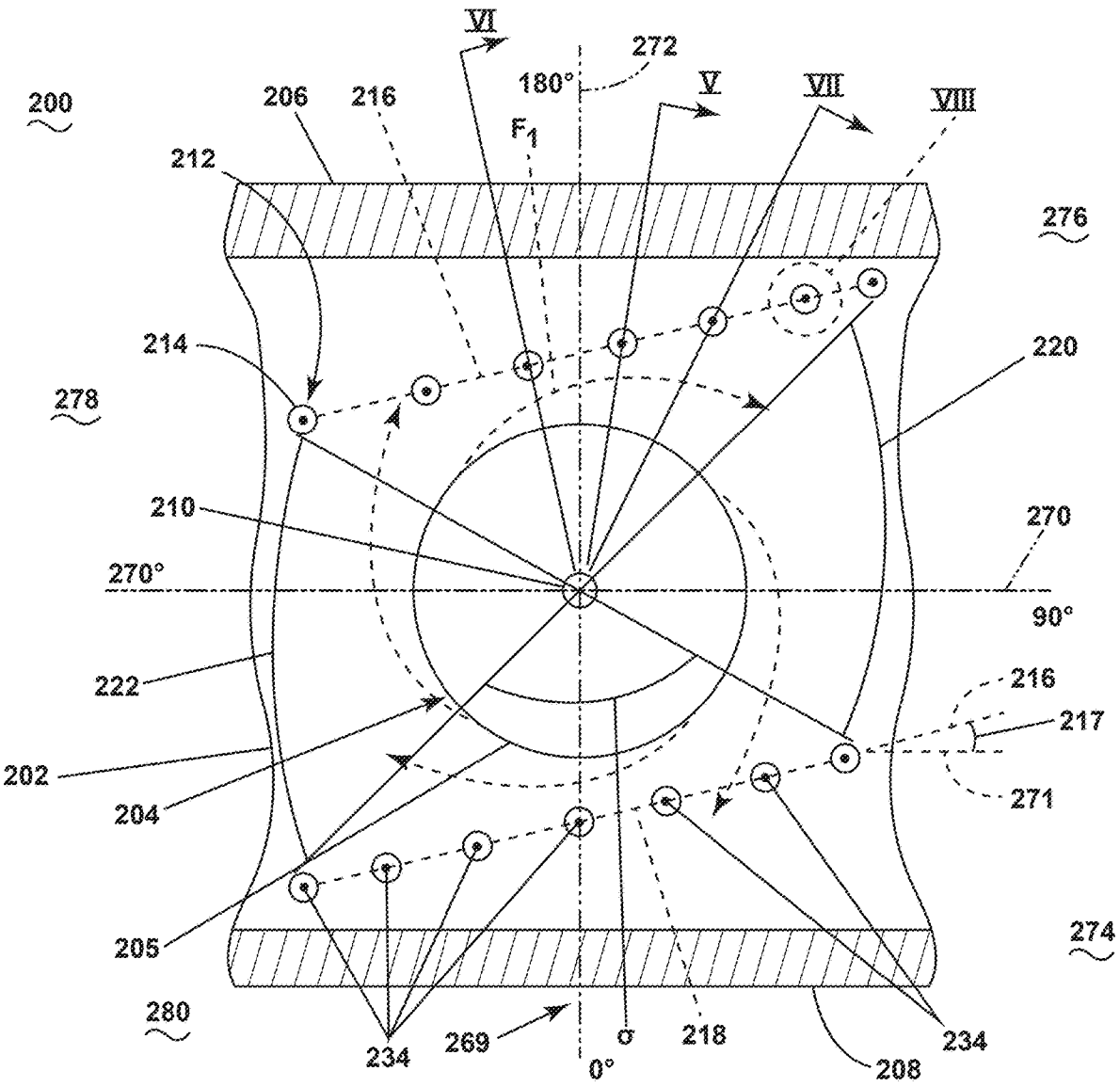
FIG. 4 is a schematic, transverse cross-sectional view of a first dilution passage arrangement provided on a dome wall suitable for use within the combustor of FIG. 3, the dilution passage arrangement having a set of dilution passages terminating at a plurality of slots provided along dome wall.

FIG. 4 is a schematic, transverse, cross-sectional view of a first dilution passage arrangement 200 on a dome wall 202 suitable for use within the combustor 80 of FIG. 3. Therefore, similar parts of the first dilution passage arrangement 200 and the combustor 80 will be given similar names, with it being understood that the description of similar parts of the combustor 80 applies to the first dilution passage arrangement 200, unless indicated otherwise. The first dilution passage arrangement 200 is provided on the dome wall 202 around a fuel cup 204 having a fuel cup centerline 210 and an outlet 205. The dome wall 202 extends between an outer liner 206 and an inner liner 208.

A plurality of dilution passages 212 extend through the dome wall 202 and include a plurality of slots 214. Each slot of the plurality of slots 214 defines a termination point of one or more dilution passages 212 of the plurality of dilution passages 212. Each dilution passage 212 extends along a passage centerline 234 that terminates at a respective slot 214 to define a center point (indicated by the passage centerline 234 on each dilution on each slot 214) of the respective slot 214. The plurality of slots 214 are circumferentially spaced about at least a portion of the fuel cup centerline 210. As a non-limiting example, a single dilution passage 212 terminates in a single slot 214. However, a dilution passage can have multiple branches, with each branch terminating in a slot. Each slot of the plurality of slots 214 is defined by a cross-sectional area when viewed along a vertical plane extending perpendicularly to the fuel cup centerline 210 and intersecting the slot 214. The cross-sectional area can be any suitable shape such as, but not limited to, obround, ovate, oblong, round, elongated, rectangular, triangular, or the like. Further, the cross-sectional area can be uniform or non-uniform amongst the plurality of slots 214 such that one or more of the slots can be larger or include a different shape than another slot.

At least a portion of the plurality of slots 214 are arranged such that the passage centerline 234 is provided along a first line 216. Another portion of the plurality of slots 214 are arranged such that their passage centerlines 234 are provided along a second line 218. As illustrated, the first line 216 and the second line 218 are arcs centered on the fuel cup centerline 210. Some of these additional paths are illustrated in the different arrangements shown in FIGS. 10-16.

The first line 216 and the second line 218 each extend over a slot-present segment defined by a slot arc angle (σ). The slot arc angle (σ) has an absolute value of greater than 0 degrees and less than or equal to 180 degrees. As a non-limiting example, the arc angle (σ) has an absolute value of greater than 30 degrees and less than or equal to 120 degrees.

The first dilution passage arrangement 200 can be positioned about the fuel cup 204 with respect to a polar coordinate system 269. The polar coordinate system 269 includes a 0 degree to 180 degree line defining a fuel cup reference line 272, and a 90 degree to 270 degree line defining a transverse reference line 270. The polar coordinate system 269 can be divided into four quadrants: a first quadrant 274 between 0-90 degrees, a second quadrant 276 between 90-180 degrees, a third quadrant 278 between 180-270 degrees and a fourth quadrant 280 between 270 to 360 degrees.

The first line 216 and the second line 218 each extend over respective segments extending circumferentially about the fuel cup centerline 210. These segments are defined as slot-present segments. A first break 220 and a second break 222 are formed circumferentially between the first line 216 and the second line 218. The first break 220 and the second break 222 define opposing slot-free segments. The first break 220 is provided within +/−75 degrees of the transverse reference line 270. The second break 222 is provided within +/−75 degrees of the transverse reference line 270.

The first line 216 and the second line 218, and thus the plurality of slots 214, can extend across or within any suitable portion of the polar coordinate system 269. As a non-limiting example, the first line 216 or the second line 218, and thus the plurality of slots 214, can extend between at least two adjacent quadrants.

The first line 216 and the second line 218 can each extend at a line angle 217 with respect to a projection 271 of the transverse reference line 270. The line angle 217 can have an absolute value of greater than or equal to 0 degrees and less than or equal to 45 degrees. The first line 216 and the second line 218 can each extend linearly at the line angle 217.

The first dilution passage arrangement 200 is symmetrical or non-symmetrical about at least one of the transverse reference line 270 or the fuel cup reference line 272.

During operation, a fuel/air mixture (F1) is supplied through the outlet 205 of the fuel cup 204. The fuel/air mixture (F1) can exit the fuel cup 204 in a straight line or otherwise include a circumferential swirl, thus defining the fuel/air mixture (F1) as a swirled fuel/air mixture. The plurality of slots 214 circumscribe at least a portion of the fuel air mixture (F1).

Figure 5:
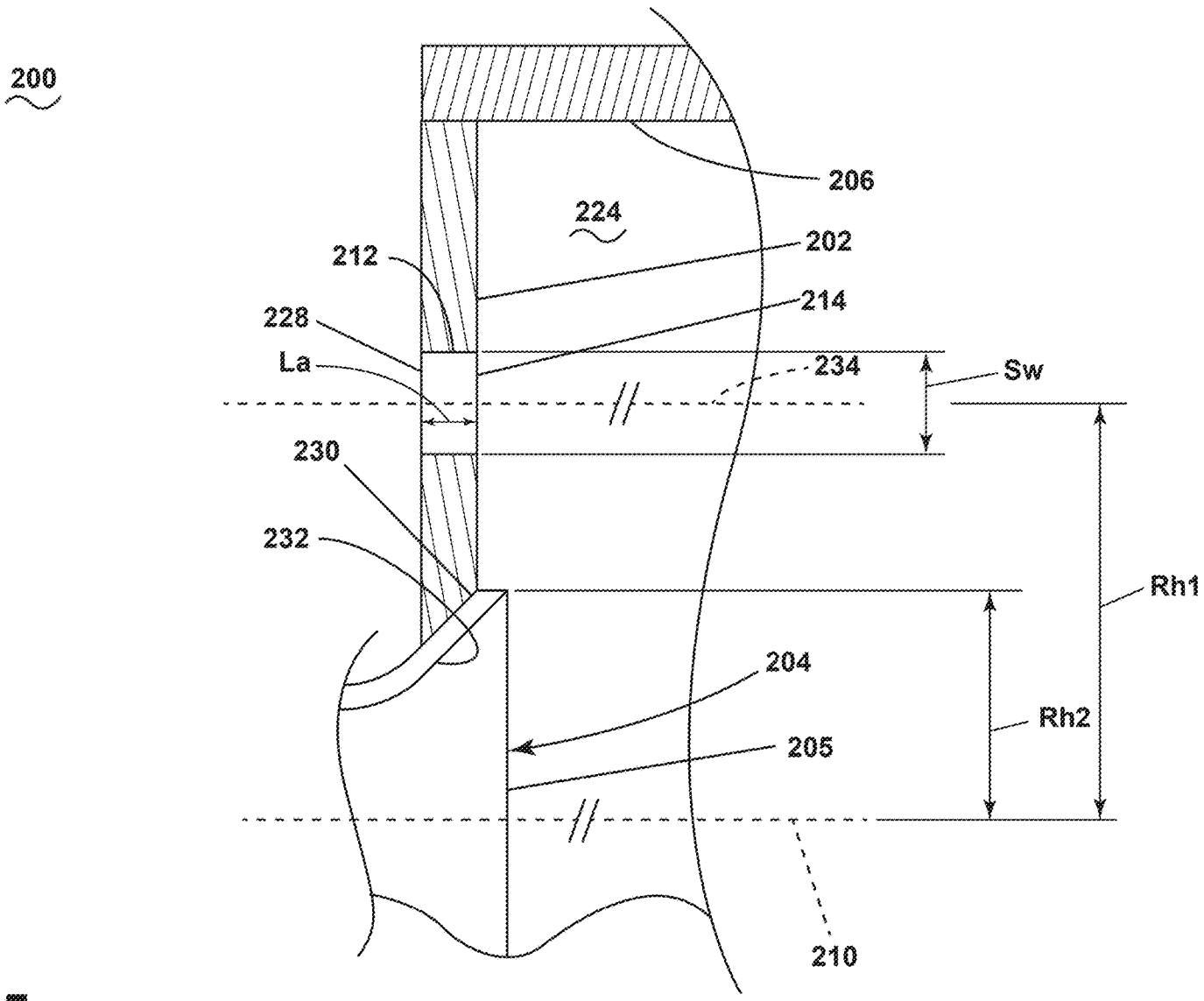
FIG. 5 is a partial side cross-sectional view of a portion of the first dilution passage arrangement of FIG. 4 as seen from line V of FIG. 4, illustrating a first passage angle defining a first orientation for the dilution passage.
Figure 6:
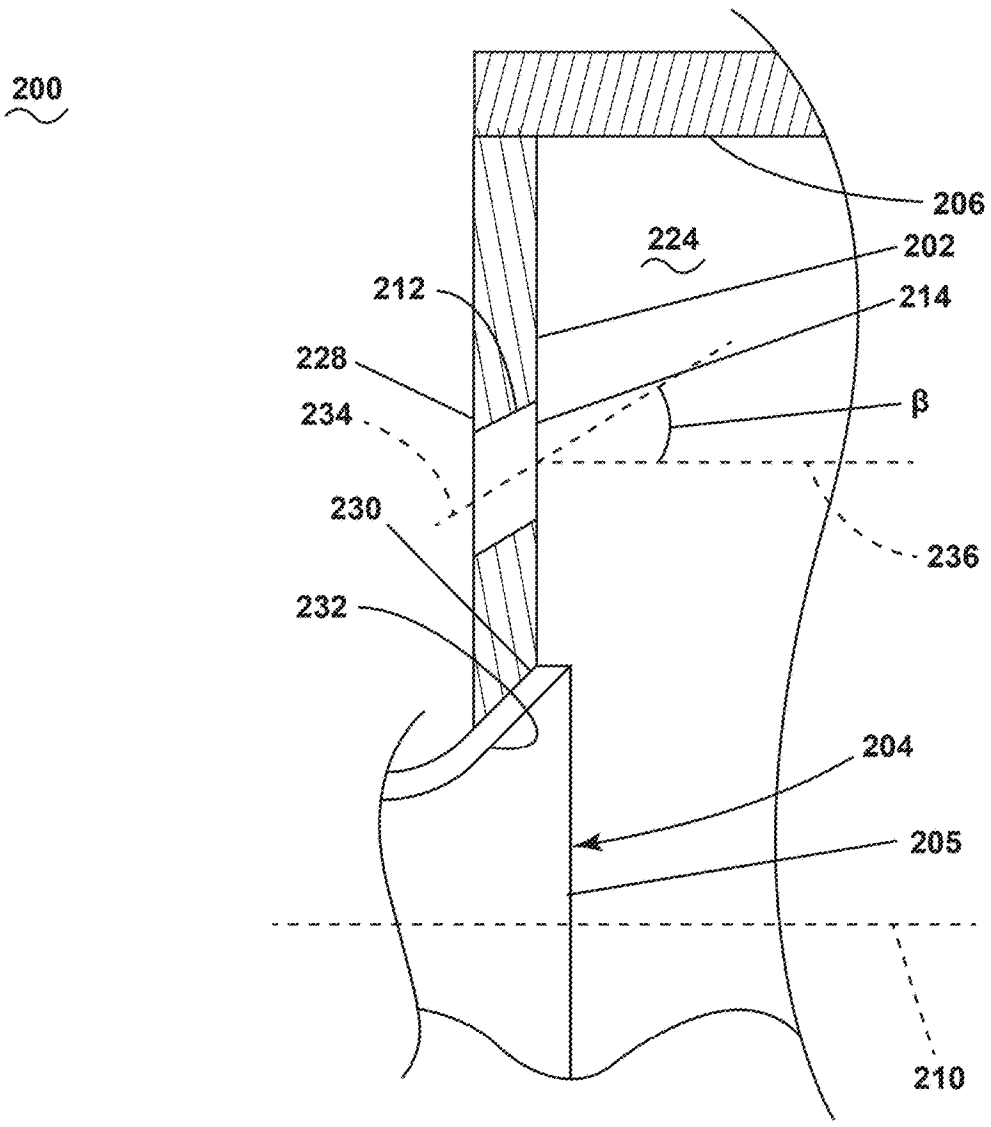
FIG. 6 is a partial side cross-sectional view of a portion of the first dilution passage arrangement as seen from line VI of FIG. 4, illustrating the first passage angel defining a second orientation for the dilution passage.
Figure 7:
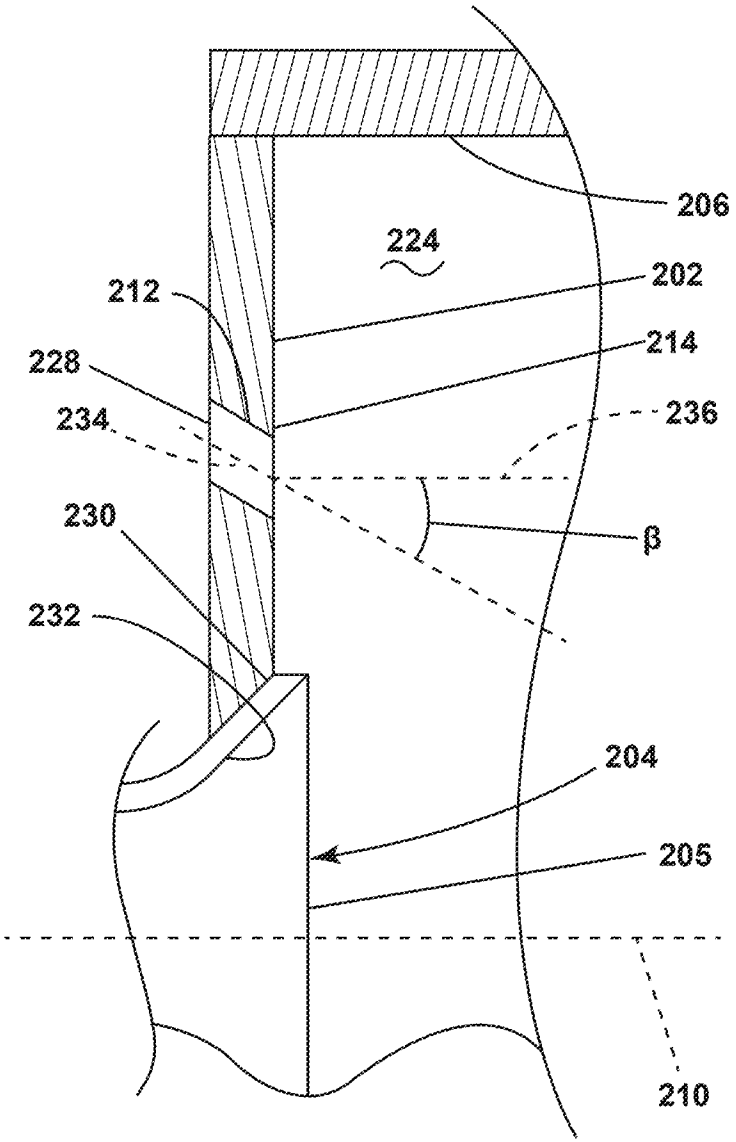
FIG. 7 is a partial side cross-sectional view of a portion of the first dilution passage arrangement of FIG. 4 as seen from line VII of FIG. 4, illustrating the first passage angel defining a third orientation for the dilution passage.

FIGS. 5-7 illustrate various non-limiting configurations of the plurality of dilution passages 212 extending through the dome wall 202. Each dilution passage 212 extends between an inlet 228 and a respective slot 214. The passage centerline 234 extends linearly or non-linearly. The fuel cup 204 includes a flare cone 230 with a flared surface 232 opening up to the outlet 205. The dome wall 202, the outer liner 206 and the inner liner 208 (FIG. 4) at least partially define a combustion chamber 224. The outlet 205 of the fuel cup 204 and the slot 214 of the dilution passage 212 are each directly fluidly coupled to respective portions of the combustion chamber 224. It will be appreciated that the dilution passage 212 can take any suitable form and include any other suitable structure. As a non-limiting example, the inlet 228 can flare outwardly to define a funnel or otherwise include a chute that extends axially from the dome wall 202, with respect to the passage centerline 234.

FIG. 5 illustrates a partial cross-sectional side view of a dilution passage 212 of the plurality of dilution passages 212 seen from line V of FIG. 4. The passage centerline 234 of the illustrated dilution passage 212 extends parallel to the fuel cup centerline 210 forming an axial dilution passage.

The passage centerline 234, specifically where the passage centerline 234 at the slot 214 (e.g., the center point of the slot 214), is provided a first radial height (Rh1) from the fuel cup centerline 210. The slot 214 is defined by a slot width (Sw). The dilution passage 212 extends from the inlet 228 to the slot 214 a total axial length (La), with respect to the fuel cup centerline 210. The outlet 205 of the fuel cup 204 extends a second radial height (Rh2) from the fuel cup centerline 210. The outlet 205, as a non-limiting example, is circular such that the second radial height (Rh2) is a radius of the outlet 205 and that two times the second radial height (Rh2) is the width of the outlet 205.

A ratio between the second radial height (Rh2) and the first radial height (Rh1) is greater than or equal to 1 and less than or equal to 3. A ratio of the slot width (Sw) to the width of the outlet 205 (e.g., two times the second radial height (Rh2)) is greater than or equal to 0.03 and less than or equal to 0.5. The slot width (Sw) can be any suitable size such as greater than or equal to 0.04 inches. A ratio between the total axial length (La) to the slot width (Sw) can be greater than or equal to 0.1 and less than or equal to 10.

It has been found that conforming the first dilution passage arrangement 200 and the fuel cup 204 to the above-described ratios and ranges provides a distinct benefit when compared to a dilution passage arrangement 200 and fuel cup 204 that does not fall within the aforementioned ratios and ranges. These benefits will be described later in the specification with respect to FIG. 9.

FIG. 6 illustrates a partial cross-sectional side view of a dilution passage 212 of the plurality of dilution passages 212 seen from line VI of FIG. 4. The passage centerline 234 of the illustrated dilution passage 212 extends radially outward from the fuel cup centerline 210 forming an outward dilution passage. The passage centerline 234 forms a first passage angle (β) with respect to a projection 236 of the fuel cup centerline 210.

FIG. 7 illustrates a partial cross-sectional side view of a dilution passage 212 of the plurality of dilution passages 212 seen from line VII of FIG. 4. The passage centerline 234 of the illustrated dilution passage 212 extends radially inward towards the fuel cup centerline 210 forming an inward dilution passage. The passage centerline 234 forms a first passage angle (β) with respect to the projection 236 of the fuel cup centerline 210.

The first passage angle (β) can be any suitable angle that is greater than or equal to negative 70 degrees and less than or equal to 70 degrees.

While illustrated as the plurality of dilution passages 212 including the axial dilution passages 212, outward dilution passages 212 and inward dilution passages 212, it will be appreciated that the plurality of dilution passages 212 can be formed as only axial dilution passages 212, only outward dilution passages 212, only inward dilution passages 212, or any suitable combination thereof.

Figure 8:
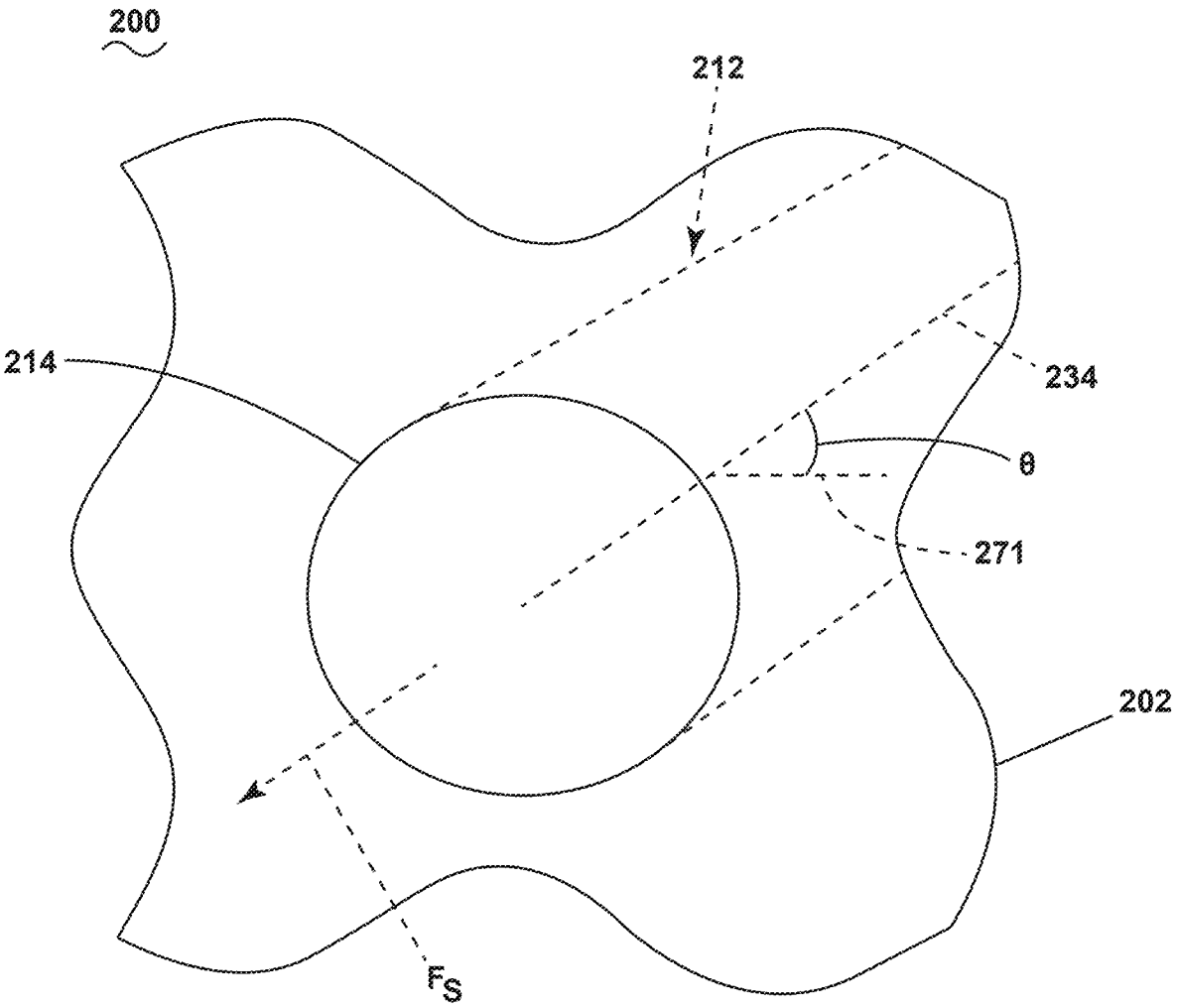
FIG. 8 is an enlarged, schematic, front view of the dome wall as seen from section VIII of FIG. 4, the dilution passage including a second passage angle.

FIG. 8 is an enlarged schematic front view of the dome wall 202 as seen from section VIII of FIG. 4. As illustrated, the dilution passage 212 includes a respective passage centerline 234 that forms a second passage angle (θ) with respect to a projection 271 of the transverse reference line 270 (FIG. 4). The second passage angle (θ) can have an absolute value of greater than or equal to 0 degrees and less than or equal to 90 degrees. As a non-limiting example, the absolute value of the second passage angle (θ) of at least a portion of the dilution passages 212 can be greater than or equal to 0 degrees and less than or equal to 30 degrees. It will be further appreciated that at least a portion of the dilution passages 212 can be formed without a second passage angle (θ) such that they extend into the illustrated page and coincide with, or otherwise circumscribe, the slot 214.

A slot airflow (Fs) can flow outward from the slot 214. The slot airflow (Fs) can include the second passage angle (θ) at the slot 214. As such, the slot airflow (Fs) can be defined by a circumferential component, with respect to the fuel cup centerline 210. The circumferential component of the slot airflow (Fs) can be in line with/parallel with, or counter to/non-parallel with the circumferential component of the fuel air mixture (F1) (FIG. 4).

Figure 9:
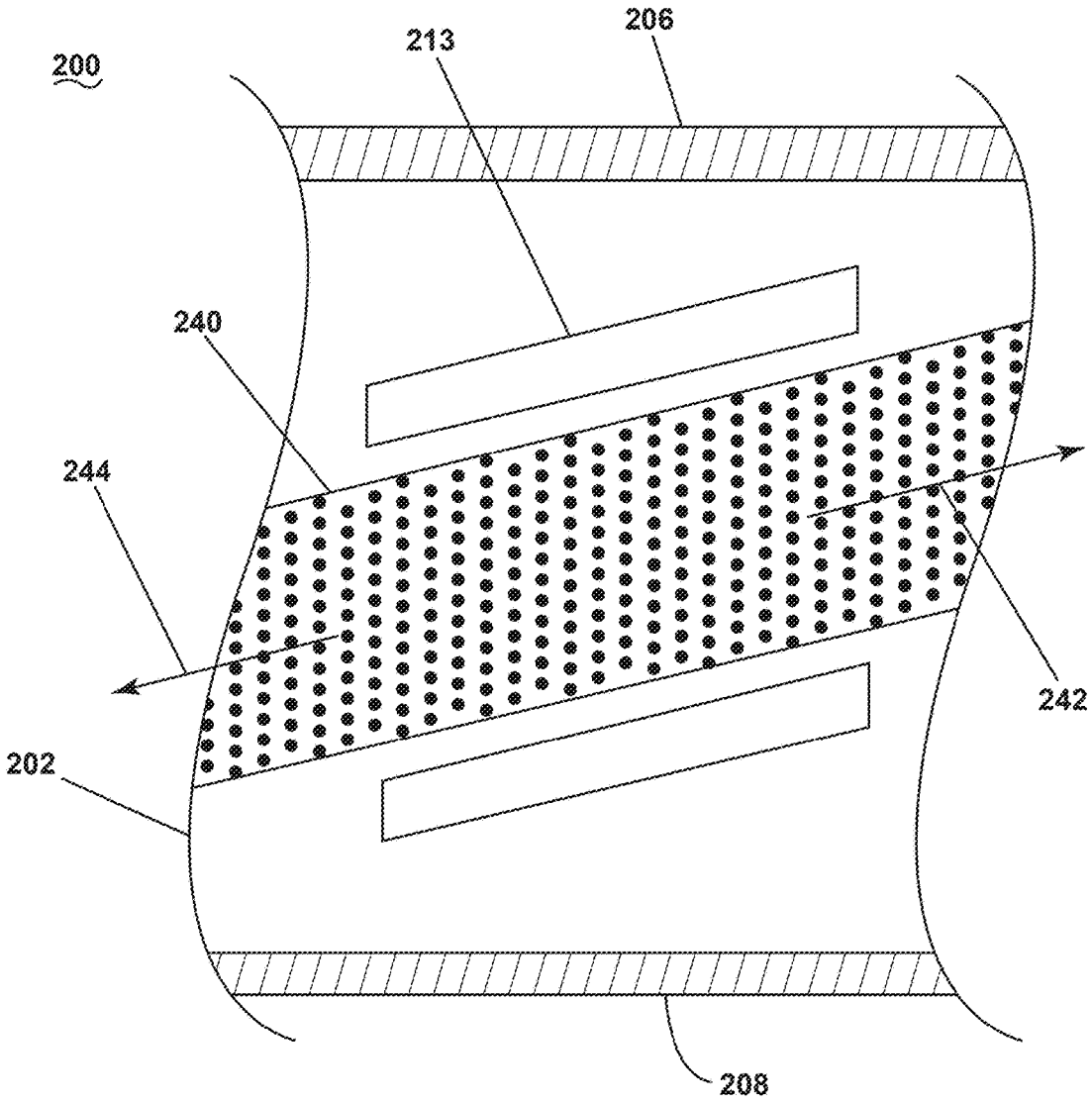
FIG. 9 is a schematic, front view of the dome wall including the dilution passage arrangement of FIG. 4, further illustrating a flame shaping attributable to the dilution passages.

FIG. 9 is a schematic front view of the dome wall 202 of FIG. 4 having the same view of FIG. 4. The dilution passage arrangement 200 includes a slot-present region 214 extending between opposing breaks 220, 222. Any number of one or more slots of the plurality of slots 214 (FIG. 4) are provided within each slot-present region 213. During operation, the fuel air mixture (F1) is ignited to define a flame 240, and a compressed airflow is fed through the plurality of dilution passages 212. The compressed airflow forms a curtain around at least a portion of the circumferential extent of the flame 240. The flame 240, however, is free to flow through the first break 220 and the second break 222 in the directions indicated by arrows 242, 244, respectively.

A plurality of fuel cups 204 (FIG. 4) are circumferentially arranged about the dome wall 202. Each fuel cup 204 can include a respective first dilution passage arrangement 200. The dilution passage arrangements 200 can be the same or different between fuel cups 204. It is contemplated that the first break 220 of a first dilution passage arrangement 200 can be at least partially aligned with a second break 222 of a second dilution passage arrangement 200 that is circumferentially adjacent to the first dilution passage arrangement 200. The flame 240 that spreads through the first break 220 of the first dilution passage arrangement 200 can meet with and merge with the flame 240 that spreads through the second break 222 of the second dilution passage arrangement 200. This merging flames 240 ensures that a continuous annular ring of flame is formed along the dome wall 202, which ensures flame propagation from one fuel cup 204 to another and reduces the likelihood of a flameout at any given one of the fuel cups 204.

The flow of compressed air flowing through the slots 214 (FIG. 4) can be defined by a total slot flow. The fuel air mixture (F1) can further be defined by a total fuel cup flow. The total slot flow and the total fuel cup flow are each defined by a volume of fluid (e.g., compressed air or fuel/air mixture, respectively) that flows through the respective slots 214 or fuel cup 204 (FIG. 4) over a period of time (e.g., milliliters/second). The ratio between the total slot flow and the total fuel cup flow can be greater than or equal to 0.2 and less than or equal to 4.

The curtain of compressed air from the dilution passages 212 is used for a multitude of reasons. First, the curtain of compressed air prevents the flame 240 from contacting or otherwise overly heating the dome wall 202, the outer liner 206 and the inner liner 208. This, in turn, ensures that that dome wall 202, the outer liner 206, the inner liner 208 or any portions of the combustor (e.g., the combustor 80 of FIG. 3) or gas turbine engine (e.g., the gas turbine engine 10 of FIG. 1) outside of the dome wall 202, the inner liner 208 or the outer liner 206 are not damaged or otherwise overly heated by the flame 240. Second, the curtain of compressed air is used to shape the flame 240. The flame shaping can be done, in part, by the first passage angle (β) (e.g., the first passage angle (β) of FIGS. 6 and 7) or the second passage angle (θ) (e.g., the second passage angle (θ) of FIG. 8). For example, an outward dilution passage 212 (FIG. 6) will allow the flame 240 to expand, thereby generating a flame 240 with a larger surface area, while an inward dilution passage 212 (FIG. 7) will compress or constrict the flame 240, thereby generating a flame 240 with a smaller surface area.

Further, the orientation of or the inclusion of the second passage angle (θ) can be used to provide a hydrodynamic curtain of compressed air oriented with respect to the fuel air mixture (F1). It has been found that the orientation of the curtain of compressed air can be used to shape and direct the flame 240. As a non-limiting example, when the circumferential component of the curtain of compressed air is non-parallel to the circumferential component of the fuel/air mixture (F1), the curtain of compressed air is better adapted to directing the flame 240 away from the outer liner 206 and the inner liner 208. As a non-limiting example, when the circumferential component of the curtain of compressed air is parallel to the circumferential component of the fuel air mixture (F1), the curtain of compressed air is better adapted to directing the flame 240 away from the dome wall 202. When the fuel/air mixture (F1) does not include a circumferential component, the curtain of compressed air is used to swirl the fuel/air mixture in a desired fashion.

The curtain of compressed air can further be used to ensure that the combustor (e.g., the combustor 80 of FIG. 2) including the first dilution passage arrangement 200 can use fuels with high burn temperatures, and burning at fast flame speeds, such as hydrogen-containing fuels. As hydrogen-containing fuels have a significantly higher burn temperature than traditional hydrocarbon fuels, it becomes more important to insulate the flame 240 from the dome wall 202, the outer liner 206 and the inner liner 208 and to cool the dome wall 202, the outer liner 206 and the inner liner 208. The air curtain that is generated through the first dilution passage arrangement 200 is used to provide a layer of insulation (e.g., the curtain of compressed air) between the flame 240 and the dome wall 202, the outer liner 206 and the inner liner 208 and to cool the dome wall 202, the outer liner 206 and the inner liner 208 and to direct the flame 240 away from the dome wall 202, the outer liner 206 and the inner liner 208.

As previously noted, conforming the first dilution passage arrangement 200 and the fuel cup 204 to the ratios and ranges described with respect to FIGS. 5-7 provides a distinct benefit when compared to a dilution passage arrangement 200 and fuel cup 204 that does not fall within the aforementioned ratios and ranges.

It is contemplated that the ratio of the slot width (Sw) to the width of the outlet 205 being greater than or equal to 0.03 and less than or equal to 0.3 results in a plurality of slots 214 that have a sufficient flow rate of compressed air with respect to a flow rate of the fuel and air mixture (F1) flowing from the fuel cup 204 in order to produce a desirable shape of the flame 240. If the ratio of the of the slot width (Sw) to the width of the outlet 205 were larger than 0.3, it has been found that too much compressed air exits the plurality of slots 214, resulting in the flame 240 having too high of a velocity or otherwise being overly compressed. If, however, the ratio of the slot width (Sw) to the width of the outlet 205 is smaller than 0.03, it has been found that the compressed air exiting the plurality of slots 214 is not sufficient in creating in the curtain of compressed air that insulates the dome wall 202, the outer liner 206 and the inner liner 208 from the heat of the flame 240, nor does the curtain of compressed air have enough force to shape the flame 240 in the desired pattern.

It is contemplated that the ratio between the total axial length (La) to the slot width (Sw) being greater than or equal to 0.1 and less than or equal to 10 results in a desired velocity of the compressed air exiting the plurality of slots 214. For example, if the ratio between the total axial length (La) to the slot width (Sw) were greater than 10, the total axial length (La) is longer, meaning that the compressed air flowing through the dilution passage 212 will frictional losses, which ultimately lowers the kinetic energy, as opposed to a lower total axial length (La). This reduction in the kinetic energy due to frictional losses ultimately results in a combustor with unsatisfactory performance when compared to a combustor falling within the desired total axial length (La) to slot width (Sw) ratio. If, however, the ratio between the total axial length (La) to the slot width (Sw) were less than 0.1, it has been found that the losses (e.g., windage losses) associated with the compressed air entering the combustion chamber and merging with the fuel and air mixture (F1) within the combustion chamber. These losses ultimately results in a combustor with unsatisfactory performance when compared to a combustor falling within the desired total axial length (La) to slot width (Sw) ratio.

Figure 10:
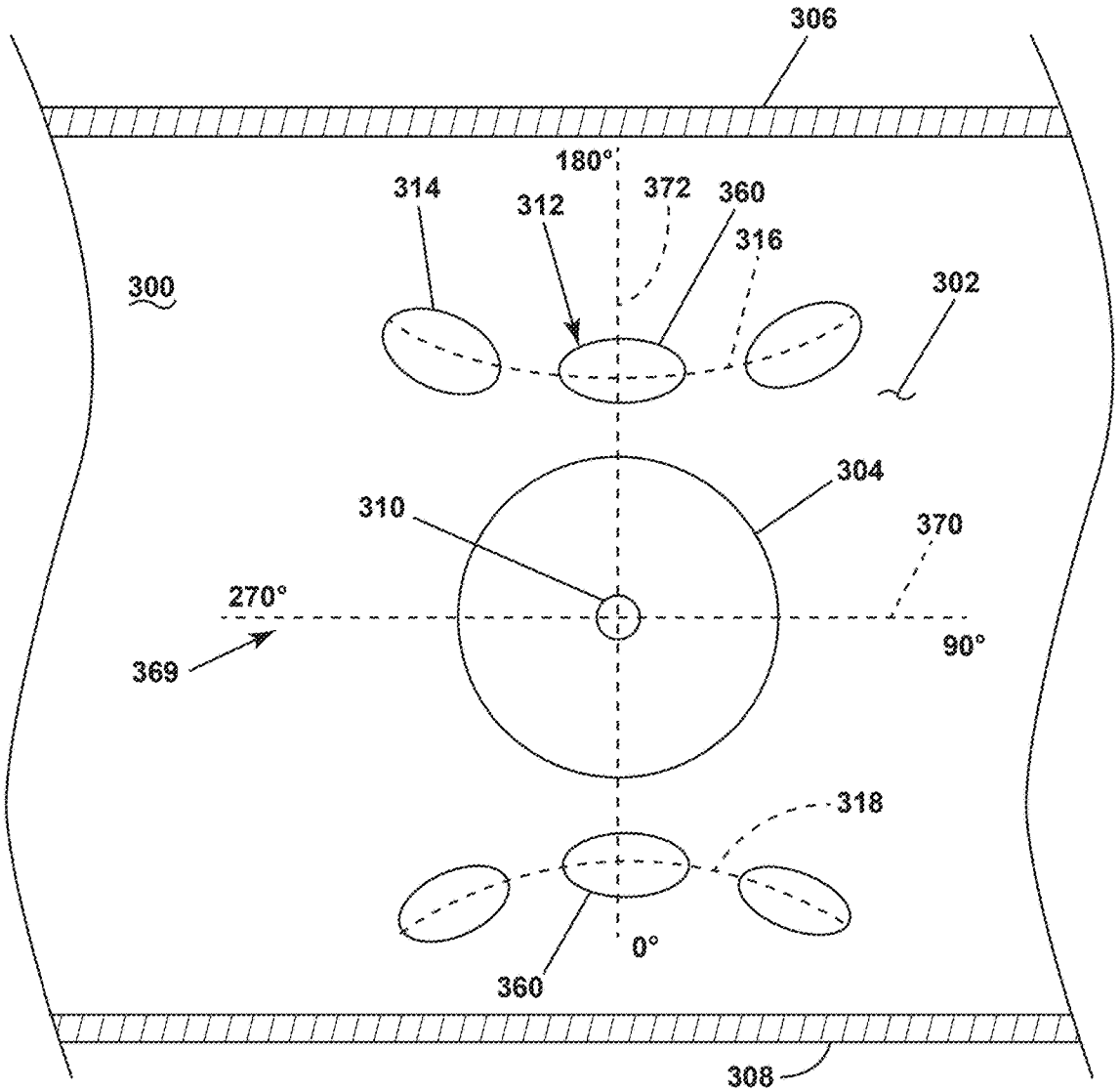
FIG. 10 is a schematic, transverse view of a second dilution passage arrangement suitable for use as the dilution passage arrangement of FIG. 4, the dilution passage arrangement including a plurality of slots following a curved line.

FIG. 10 is a schematic, transverse cross-sectional view of an exemplary second dilution passage arrangement 300 suitable for use as the first dilution passage arrangement 200 of FIG. 4. The second dilution passage arrangement 300 is similar to the first dilution passage arrangement 200, therefore, like parts will be identified by like numerals increased to the 300 series, with it being understood that the description of the first dilution passage arrangement 200 applies to the second dilution passage arrangement 300, unless otherwise noted.

The second dilution passage arrangement 300 is provided on a dome wall 302 and surrounding a fuel cup 304 having a fuel cup centerline 310. The dome wall 302 extends radially between an outer liner 306 and an inner liner 308. A plurality of dilution passages 312 extend through the dome wall 302 and terminate in a plurality of slots 314 formed along the dome wall 302. The second dilution passage arrangement 300 is provided along a polar coordinate system 369 having a fuel cup reference line 372 extending from 0 degrees to 180 degrees and a transverse reference line 370 extending from 90 degrees to 270 degrees. The plurality of slots 314 extend along, at least, a first line 316 and a second line 318.

The second dilution passage arrangement 300 is similar to the first dilution passage arrangement 200, except that the first line 316 and the second line 318 each decrease in radial distance circumferentially in either direction from a radially closest slot 360 of the plurality of slots 314. In other words, the first line 316 and the second line 318 each diverge radially outward from the radially closest slot 360 and with respect to the fuel cup centerline 310.

As illustrated, the first line 316 and the second line 318 are formed as semi-circles or are otherwise curved lines. The curvature of the first line 316 opposes the curvature of the second line 318 such that the first line 316 and the second line 318 converge towards one another to their respective radially closest slot 360. It will be appreciated, however, that the first line 316 and the second line 318 can take any suitable linear or non-linear shape.

Benefits associated with the dilution passage arrangement 300 having the first line 316 and the second line 318 formed as semi-circles or otherwise having opposing curvatures, with respect to the first dilution passage arrangement 200, include better containment of the flame (e.g., the flame 240 of FIG. 9) along with a greater cup-to-cup interaction. It is contemplated that the opposing curvatures of the first line 316 and the second line 318 can create a curtain of compressed air with a circumferential component that opposes the circumferential component of the flame. This, in turn, helps in containing the flame or otherwise stopping the flame form overly heating the dome wall 302, the inner liner (e.g., the inner liner 208 of FIG. 4) and the outer liner (e.g., the outer liner 206 of FIG. 4). Further, it is contemplated that the opposing curvature creates a larger first break and second break between the plurality of slots 314, when compared to the first dilution passage arrangement 200. This, in turn, ensures that the flame can flare radially outward, with respect to the combustor centerline (e.g., the combustor centerline 36 of FIG. 2), from the opposing breaks and have a higher likelihood of merging with a flame from an adjacent fuel cup 304.

Figure 11:
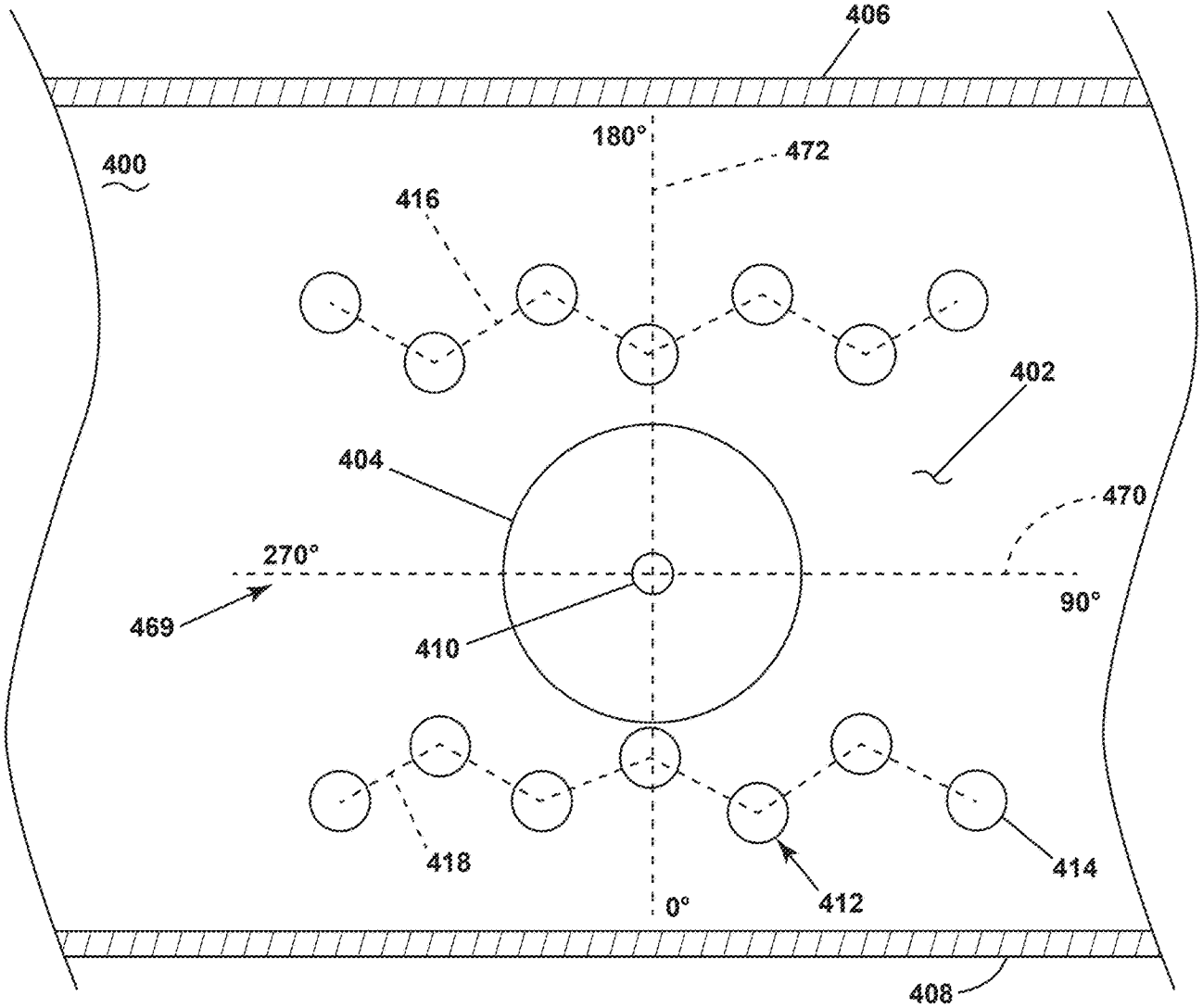
FIG. 11 is a schematic, transverse view of a third dilution passage arrangement suitable for use as the dilution passage arrangement of FIG. 4, the dilution passage arrangement including a series of non-parallel legs.

FIG. 11 is a schematic, transverse cross-sectional view of an exemplary third dilution passage arrangement 400 suitable for use as the first dilution passage arrangement 200 of FIG. 4. The third dilution passage arrangement 400 is similar to the dilution passage arrangement 200, 300 (FIG. 10), therefore, like parts will be identified by like numerals increased to the 400 series, with it being understood that the description of the dilution passage arrangement 200, 300 applies to the third dilution passage arrangement 400, unless otherwise noted.

The third dilution passage arrangement 400 is provided on a dome wall 402 and surrounding a fuel cup 404 having a fuel cup centerline 410. The dome wall 402 extends radially between an outer liner 406 and an inner liner 408. A plurality of dilution passages 412 extend through the dome wall 402 and terminate in a plurality of slots 414 formed along the dome wall 402. The third dilution passage arrangement 400 is provided along a polar coordinate system 469 having a fuel cup reference line 472 extending from 0 degrees to 180 degrees and a transverse reference line 470 extending from 90 degrees to 270 degrees. The plurality of slots 414 extend along, at least, a first line 416 and a second line 418.

The third dilution passage arrangement 400 is similar to the dilution passage arrangement 200, 300, except that the first line 416 and the second line 418 include a series of non-parallel legs. The series of non-parallel legs can together form an undulating pattern such as, but not limited to, a zig-zag pattern. While shown as a series of inverse and right-side up V's, it will be appreciated that the first line 416 and the second line 418 can instead include any suitable undulating formation such as the zig-zag pattern, a step pattern or a wave formation.

The third dilution passage arrangement 400 can be further defined as a dilution passage arrangement that includes a plurality of slots 414 with varying radial distances from the fuel cup centerline 410. As a non-limiting example, the third dilution passage arrangement 400 can include alternating varying radial distances between adjacent slots of the plurality of slots 414. In other words, a first slot adjacent to a second slot and a third slot can have a larger or smaller radial distance than the radial distance of the second slot and the third slot.

Benefits associated with the plurality of slots 414 having varying radial distances include an increased turbulence, when compared to the dilution passage arrangement 200 (FIG. 4), 300 (FIG. 10). It is contemplated that having the varying radial distances, with respect to the fuel cup centerline 410, creates a turbulent airflow within the curtain of compressed air. This, in turn, at least partially cools the flame that comes into contact with the curtain of compressed air, thus increasing the insulative properties of the curtain of compressed air. Further, the reduction of the temperature of the flame can result in a decrease in the total NOx emission from the flame.

Figure 12:
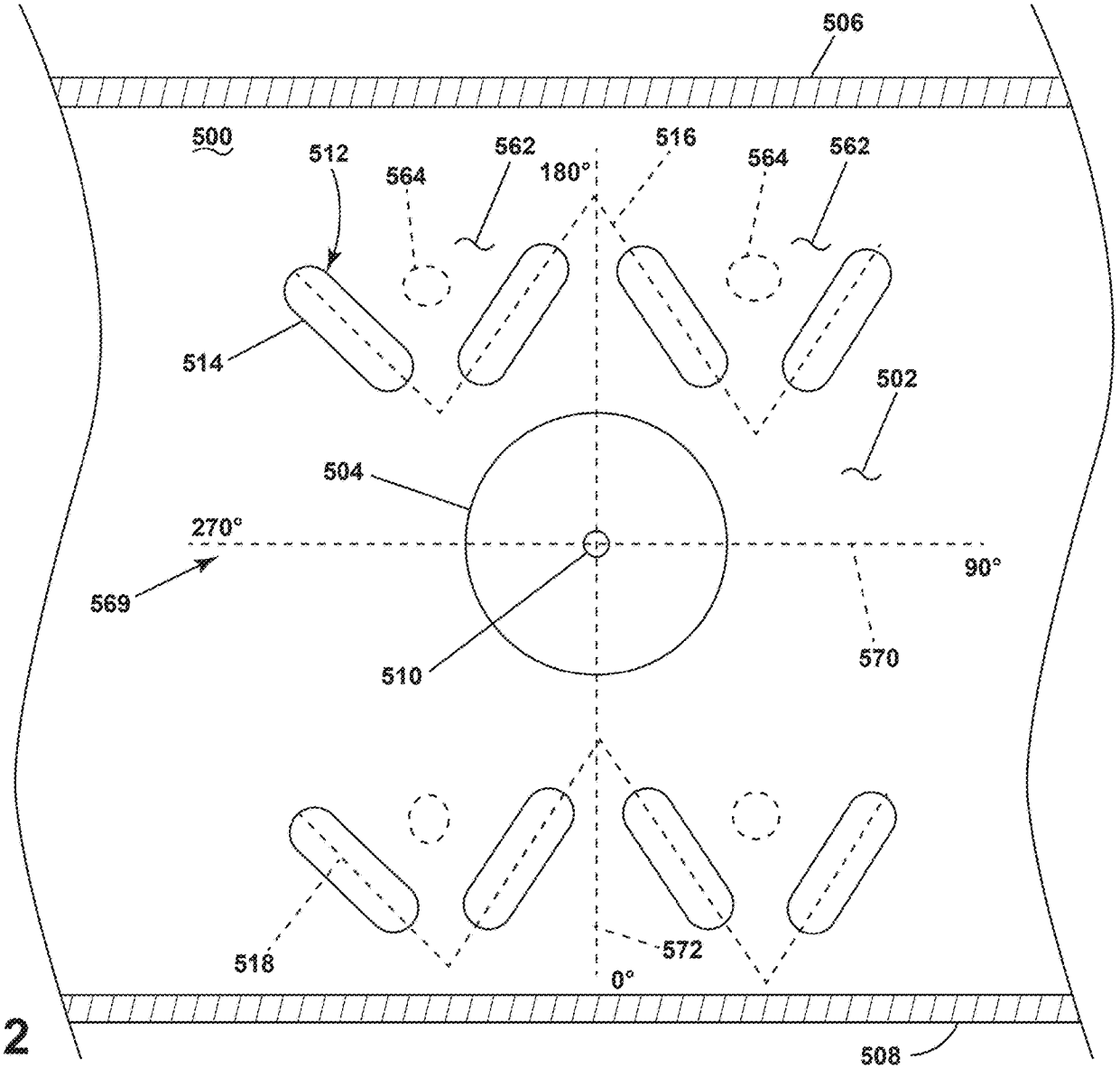
FIG. 12 is a schematic, transverse view of a fourth dilution passage arrangement suitable for use as the dilution passage arrangement of FIG. 4, the dilution passage arrangement including a series of non-parallel legs and further including at least one intermediate slot.

FIG. 12 is a schematic, transverse view of an exemplary fourth dilution passage arrangement 500 suitable for use as the first dilution passage arrangement 200 of FIG. 4. The fourth dilution passage arrangement 500 is similar to the dilution passage arrangement 200, 300 (FIG. 10), 400 (FIG. 11), therefore, like parts will be identified by like numerals increased to the 500 series, with it being understood that the description of the dilution passage arrangement 200, 300, 400 applies to the fourth dilution passage arrangement 500, unless otherwise noted.

The fourth dilution passage arrangement 500 is provided on a dome wall 502 and surrounding a fuel cup 504 having a fuel cup centerline 510. The dome wall 502 extends radially between an outer liner 506 and an inner liner 508. A plurality of dilution passages 512 extend through the dome wall 502 and terminate in a plurality of slots 514 formed along the dome wall 502. The fourth dilution passage arrangement 500 is provided along a polar coordinate system 569 having a fuel cup reference line 572 extending from 0 degrees to 180 degrees and a transverse reference line 570 extending from 90 degrees to 270 degrees.

The fourth dilution passage arrangement 500 is similar to the third dilution passage arrangement 400 in that it includes a first line 516 and a second line 518, that extend along a zig-zag or other undulating formation. The difference, however, is that at least a portion of the plurality of slots 514 include a cross-sectional area that is oblong. Specifically, the plurality of slots 514 provided on the first line 516 and the second line are oblong. The oblong slots form a chevron or "V" shape that at least partially bound an interior 562. As a non-limiting example, at least one additional slot 564 (illustrated in phantom lines) of the plurality of slots 514 can be provided within at least one interior 562.

Like the third dilution passage arrangement 400, the fourth dilution passage arrangement 500 is well suited to create a layer of turbulence of compressed air. This, in turn, increases the insulative properties of the curtain of compressed air and further reduces the NOx emissions.

Figure 13:
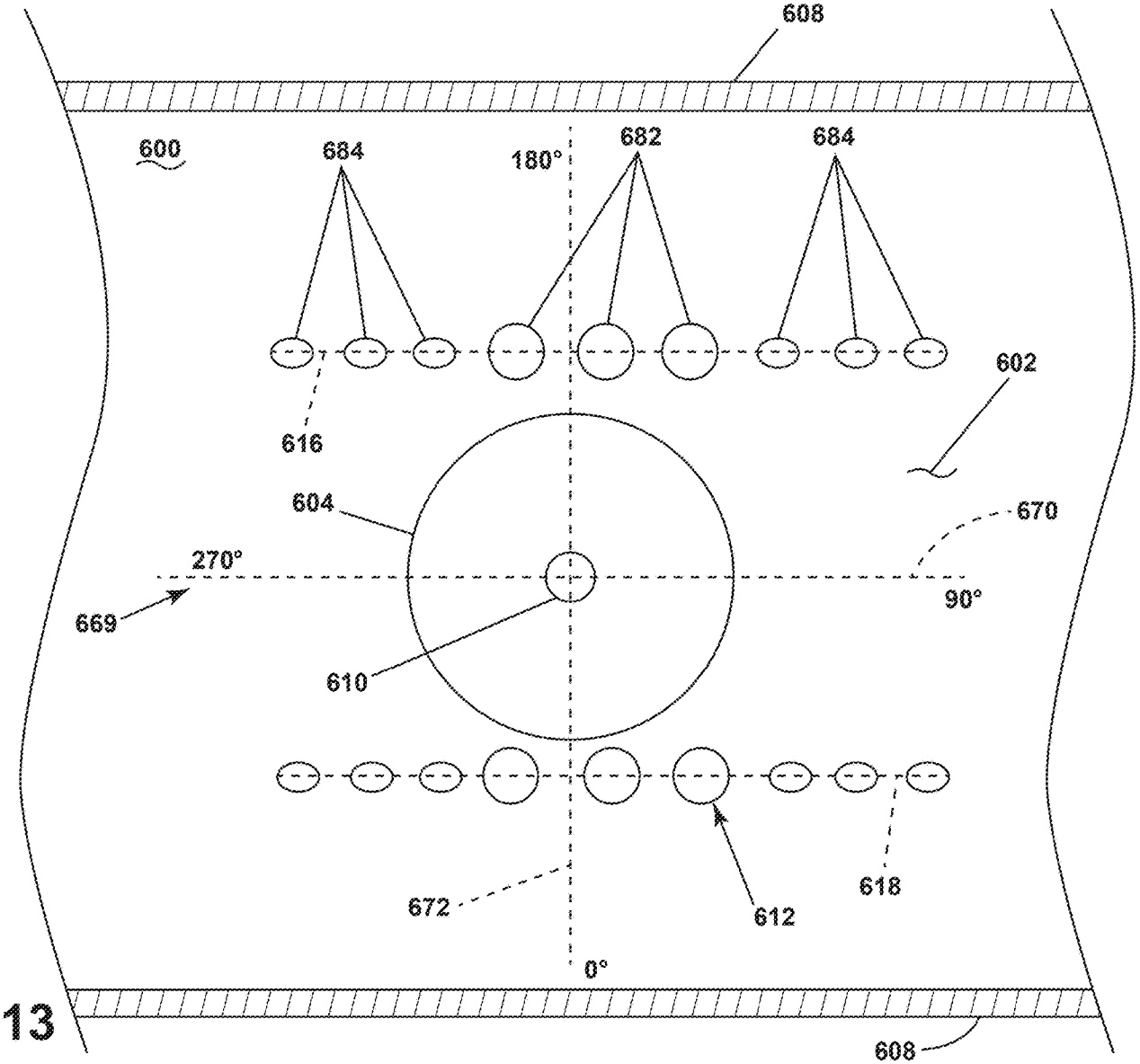
FIG. 13 is a schematic, transverse view of a fifth dilution passage arrangement suitable for use as the dilution passage arrangement of FIG. 4, the dilution passage arrangement including a first group of slots and a second group of slots arranged along the line.

FIG. 13 is a schematic, transverse view of an exemplary fifth dilution passage arrangement 600 suitable for use as the first dilution passage arrangement 200 of FIG. 4. The fifth dilution passage arrangement 600 is similar to the dilution passage arrangement 200, 300 (FIG. 10), 400 (FIG. 11), 500 (FIG. 12), therefore, like parts will be identified by like numerals increased to the 600 series, with it being understood that the description of the dilution passage arrangement 200, 300, 400, 500 applies to the fifth dilution passage arrangement 600, unless otherwise noted.

The fifth dilution passage arrangement 600 is provided on a dome wall 602 and surrounding a fuel cup 604 having a fuel cup centerline 610. The dome wall 602 extends radially between an outer liner 606 and an inner liner 608. A plurality of dilution passages 612 extend through the dome wall 602. The fifth dilution passage arrangement 600 is provided along a polar coordinate system 669 having a fuel cup reference line 672 extending from 0 degrees to 180 degrees and a transverse reference line 670 extending from 90 degrees to 270 degrees.

The set of dilution passages 612 terminate in a first group of slots 682 and a second group of slots 684, each disposed on a first line 616 and a second line 618. The first group of slots 682 can have a different formation with respect to the second group of slots 682. As a non-limiting example, each slot of the first group of slots 682 can include a cross-sectional area that is larger than or smaller than a cross-sectional area of each slot of the second group of slots 684. As a non-limiting example, each slot of the second group of slots 684 can include a second passage angle (e.g., the second passage angle (θ) of FIG. 8) while each slot of the first group of slots 682 does not. As a non-limiting example, the first group of slots 682, provided circumferentially closer to the fuel cup reference line 672 than the second group of slots 684, can have a smaller second passage angle than the second group of slots 684.

The first group of slots 682 and the second group of slots 684 can each be continuously provided on a suitable portion of the first line 616 and the second line 618. As a non-limiting example, there can be two separate groups of the second group of slots 684 per the first line 616 and second line 618. As a non-limiting example, the second group of slots 684 can be provided along circumferentially distal ends of the first line 616 and second line 618. It will be appreciated that the fifth dilution passage arrangement 600 can include any number of two or more groups of slots.

The benefit of including the fifth dilution passage arrangement 600 having the first group of slots 682 and the second group of slots 684 is that the fifth dilution passage arrangement 600 allows for tuning of the flame shape and cooling/insulation efficiency of the fifth dilution passage arrangement 600. As a non-limiting example, the second group of slots 684 can be provided along circumferentially distal ends of the first line 616 and the second line 618 and include the second passage angle. The first group of slots 682 can be provided circumferentially between the second group of slots 684. As such, the second group of slots 684 can be used to provide the hydrodynamic curtain of air that is in-line with or counter to the fuel air mixture, as described herein, while the first group of slots 682 can be used to compress or expand the flame.

Figure 14:
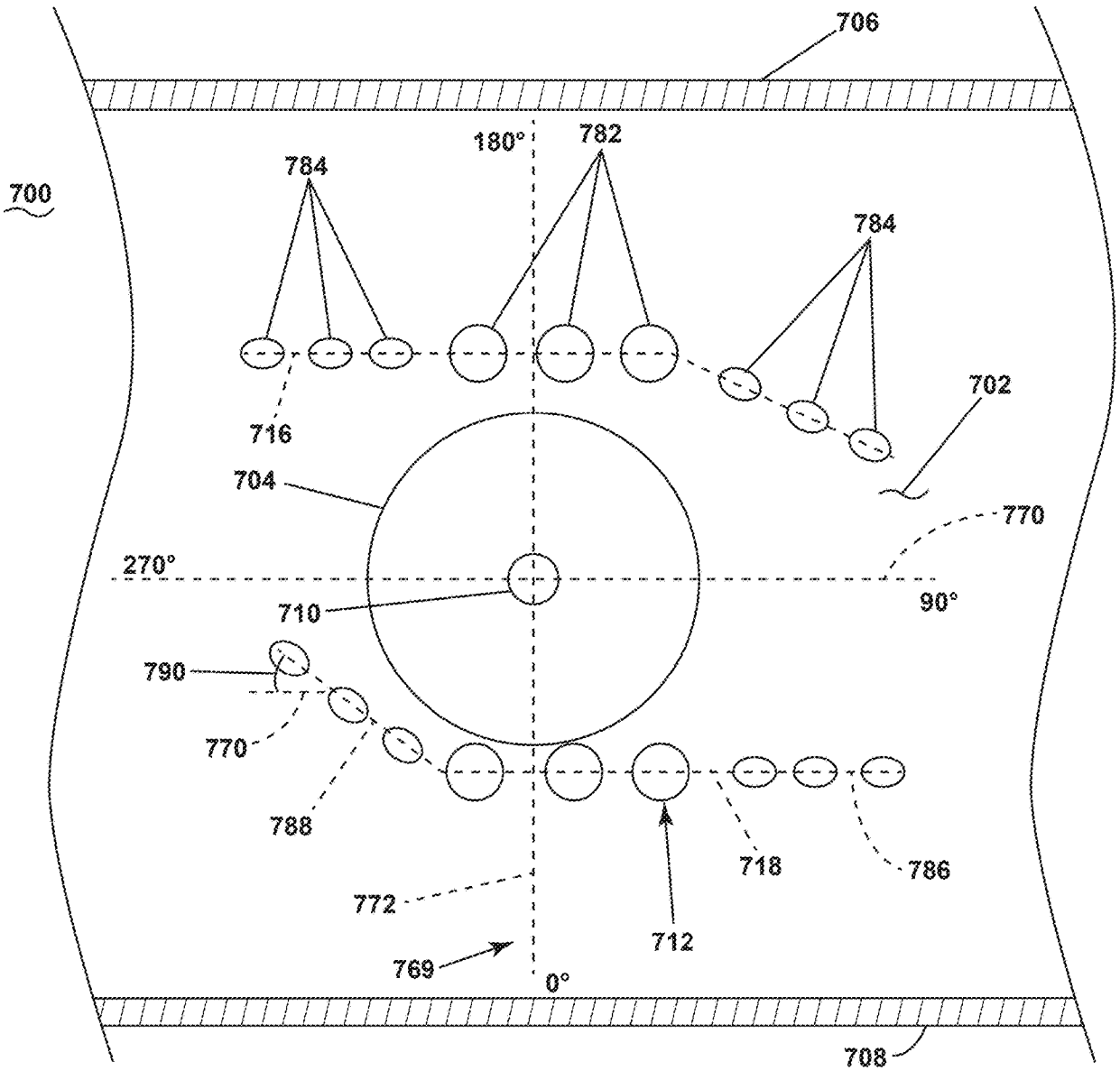
FIG. 14 is a schematic, transverse view of a sixth dilution passage arrangement suitable for use as the dilution passage arrangement of FIG. 4, the dilution passage arrangement including a first group of slots and a second group of slots arranged along a first line and a second line.

FIG. 14 is a schematic, transverse view of an exemplary sixth dilution passage arrangement 700 suitable for use as the first dilution passage arrangement 200 of FIG. 4. The sixth dilution passage arrangement 700 is similar to the dilution passage arrangement 200, 300 (FIG. 10), 400 (FIG. 11), 500 (FIG. 12), 600 (FIG. 13), therefore, like parts will be identified by like numerals increased to the 700 series, with it being understood that the description of the dilution passage arrangement 200, 300, 400, 500, 600 applies to the sixth dilution passage arrangement 700, unless otherwise noted.

The sixth dilution passage arrangement 700 is provided on a dome wall 702 and surrounding a fuel cup 704 having a fuel cup centerline 710. The dome wall 702 extends radially between an outer liner 706 and an inner liner 708. A plurality of dilution passages 712 extend through the dome wall 702. The sixth dilution passage arrangement 700 is provided along a polar coordinate system 769 having a fuel cup reference line 772 extending from 0 degrees to 180 degrees and a transverse reference line 770 extending from 90 degrees to 270 degrees. The set of dilution passages 712 terminate in a first group of slots 782 and a second group of slots 784, each disposed on a first line 716 and a second line 718.

The sixth dilution passage arrangement 700, like the fifth dilution passage arrangement 600, includes the plurality of dilution passages 712 that terminate in a first group of slots 782 and a second group of slots 784. The first group of slots 782 can be formed the same as or different from the second group of slots 784. The difference, however, is that a first line 716 and a second line 718 each include a first leg 786 and a second leg 788 extending from a circumferential end of the first leg 786. The first leg 786 is non-parallel to the second leg 788 or otherwise has some differing formation. As a non-limiting example, the first leg 786 can extend linearly and parallel to the transverse reference line 770, while the second leg 788 can extend toward the transverse reference line 770 from the circumferential end of the first leg 786. The second leg 788 can extend at a leg angle 790 with respect to the transverse reference line 770. The leg angle 790 can have an absolute value of greater than 0 degrees and less than or equal to 80 degrees.

Figure 15:
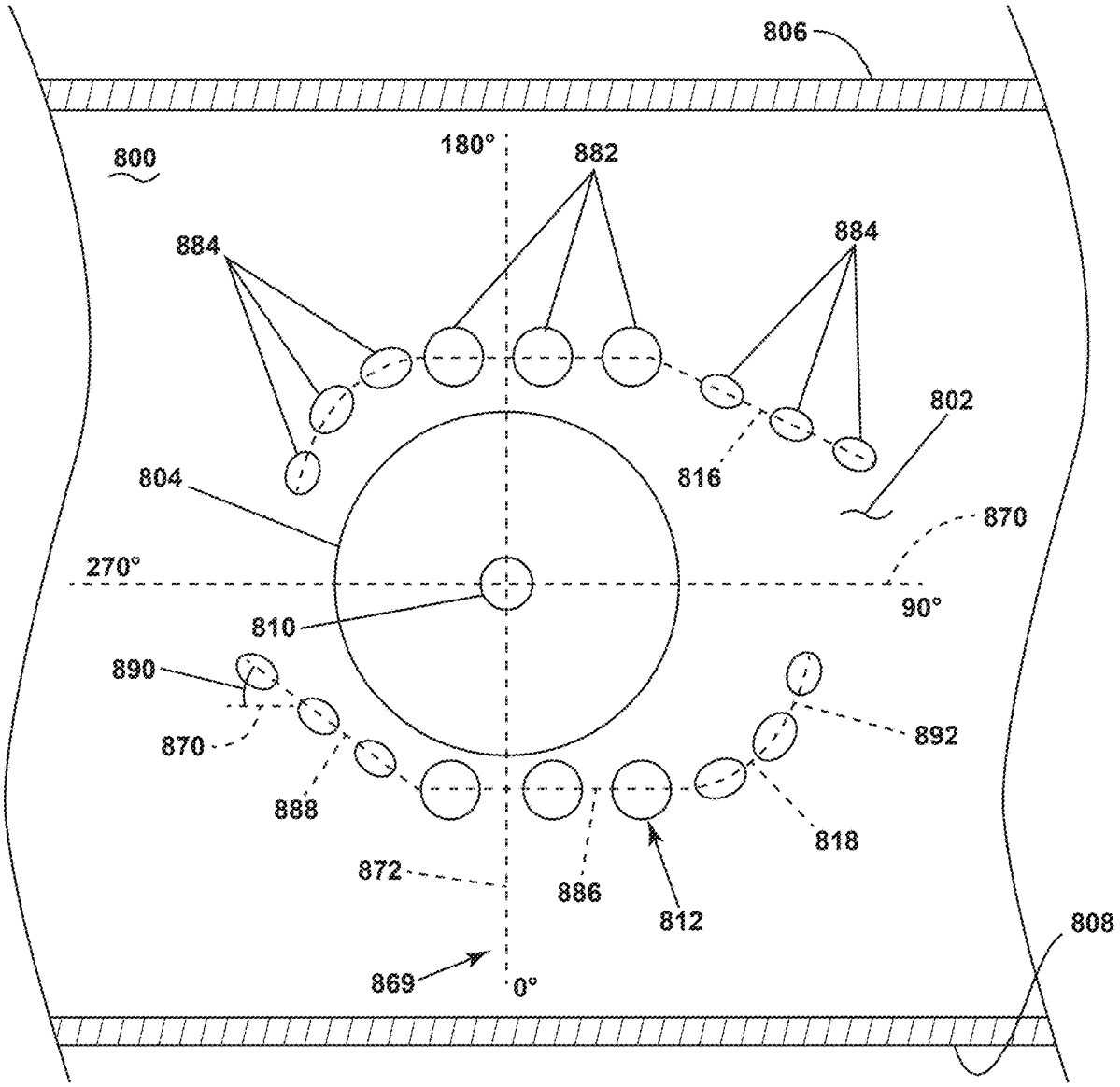
FIG. 15 is a schematic, transverse view of a seventh dilution passage arrangement suitable for use as the dilution passage arrangement of FIG. 4, the dilution passage arrangement including a first group of slots and a second group of slots arranged along a first line, a second line and a third line.

FIG. 15 is a schematic, transverse view of an exemplary seventh dilution passage arrangement 800 suitable for use as the first dilution passage arrangement 200 of FIG. 4. The seventh dilution passage arrangement 800 is similar to the dilution passage arrangement 200, 300 (FIG. 10), 400 (FIG. 11), 500 (FIG. 12), 600 (FIG. 13), 700 (FIG. 14), therefore, like parts will be identified by like numerals increased to the 800 series, with it being understood that the description of the dilution passage arrangement 200, 300, 400, 500, 600, 700 applies to the seventh dilution passage arrangement 800, unless otherwise noted.

The seventh dilution passage arrangement 800 is provided on a dome wall 802 and surrounding a fuel cup 804 having a fuel cup centerline 810. The dome wall 802 extends radially between an outer liner 806 and an inner liner 808. A plurality of dilution passages 812 extend through the dome wall 802. The seventh dilution passage arrangement 800 is provided along a polar coordinate system 869 having a fuel cup reference line 872 extending from 0 degrees to 180 degrees and a transverse reference line 870 extending from 90 degrees to 270 degrees.

The seventh dilution passage arrangement 800 is similar to the fifth dilution passage arrangement 600, and sixth dilution passage arrangement 700 in that it includes the plurality of dilution passages 812 that terminate in a first group of slots 882 and a second group of slots 884. The first group of slots 882 can be formed the same as or different from the second group of slots 884. The seventh dilution passage arrangement 800, like the sixth dilution passage arrangement 700, includes a first line 816 and a second line 818 with a first leg 886 and a second leg 888 extending from a circumferential end of the first leg 886. The second leg 888 can extend at a leg angle 890, with respect to the transverse reference line 870, while the first leg 886 can extend parallel to or non-parallel to the transverse reference line 870.

The first line 816 and the second line 818, however, further include a third leg 892 that extends from a circumferentially opposite end of the first leg 886 from where the second leg 888 extends from. The third leg 892, like the second leg 888, extends from the first leg 886 and towards the transverse reference line 870. The third leg 892, however, is formed as a non-linear line. As a non-limiting example, the third leg 892 can be formed as a curved line that extends circumferentially about the fuel cup centerline 810. It will be appreciated that the second leg 888 and the third leg 892 can have the same or differing formations. For example, the second leg 888 can be a curved line, while the third leg 892 is a linear line.

The first leg 886, the second leg 888 and the third leg 892 can be provided in any one or more suitable quadrants (e.g. first quadrant 274, second quadrant 276, third quadrant 278, fourth quadrant 280 of FIG. 4) of the polar coordinate system 869.

The benefit of including the dilution passage arrangement 700, 800 over the fifth dilution passage arrangement 600 is that the dilution passage arrangement 700, 800 allows for additional tuning of the flame shape and size. For example, the inclusion of the second leg 788, 888 and/or the third leg 892 allows for additional shaping of the flame by swirling and/or directing the flame into a desired formation. As a non-limiting example, the second group of slots 784, 884 can be formed on the second leg 788, 888 and/or the third leg 892 and include, at least, a second passage angle that creates an airflow that is counter to or in line with the swirled air/fuel mixture.

Figure 16:
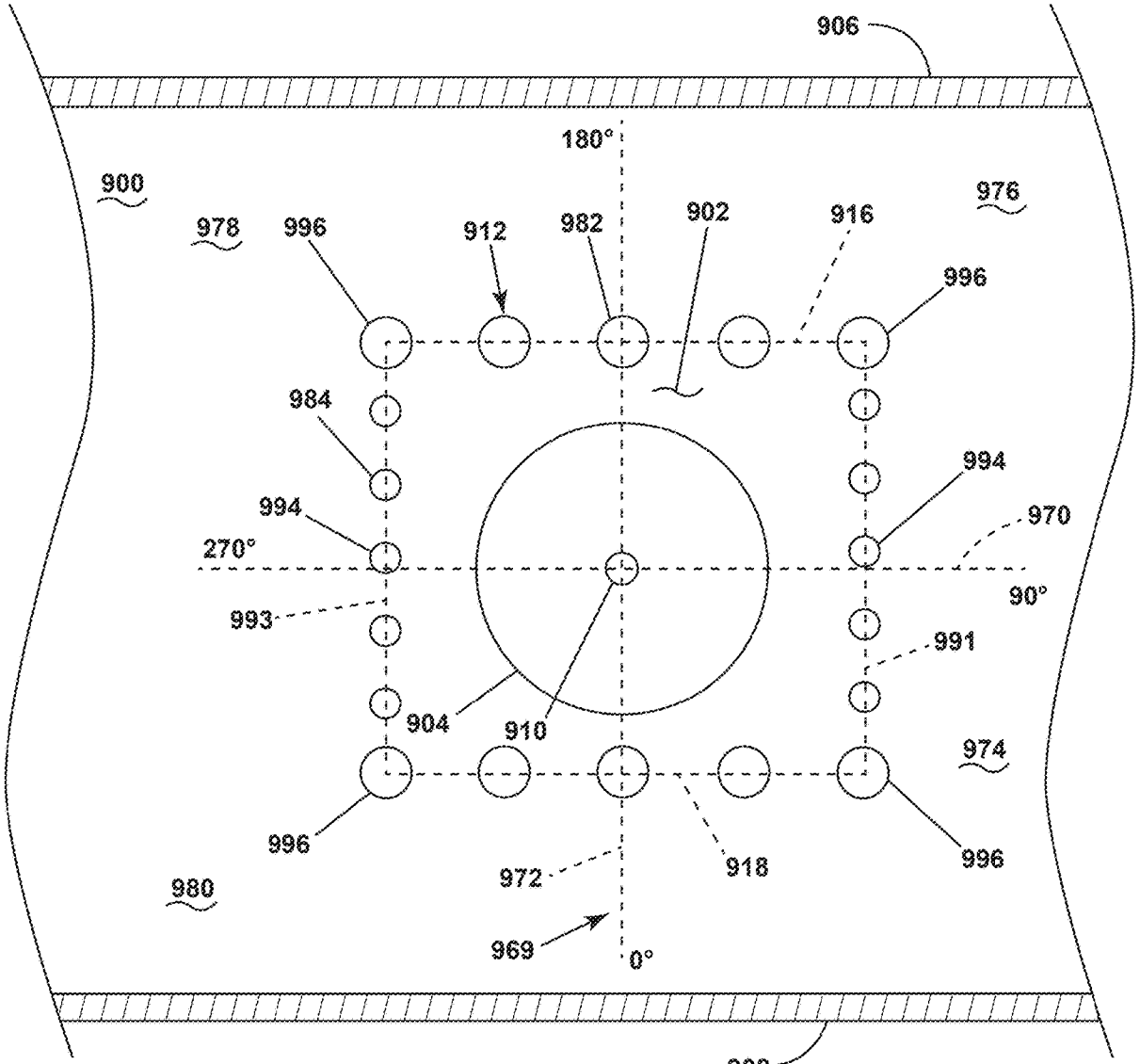
FIG. 16 is a schematic, transverse view of a eighth dilution passage arrangement suitable for use as the dilution passage arrangement of FIG. 4, the dilution passage arrangement including a first group of slots and a second group of slots arranged along a continuous line.

FIG. 16 is a schematic, transverse view of an exemplary eighth dilution passage arrangement 900 suitable for use as the first dilution passage arrangement 200 of FIG. 4. The eighth dilution passage arrangement 900 is similar to the dilution passage arrangement 200, 300 (FIG. 10), 400 (FIG. 11), 500 (FIG. 12), 600 (FIG. 13), 700 (FIG. 14), 800 (FIG. 15), therefore, like parts will be identified by like numerals increased to the 900 series, with it being understood that the description of the dilution passage arrangement 200, 300, 400, 500, 600, 700, 800 applies to the eighth dilution passage arrangement 900, unless otherwise noted.

The eighth dilution passage arrangement 900 is provided on a dome wall 902 and surrounding a fuel cup 904 having a fuel cup centerline 910. The dome wall 902 extends radially between an outer liner 906 and an inner liner 908. A plurality of dilution passages 912 extend through the dome wall 902. The eighth dilution passage arrangement 900 is provided along a polar coordinate system 969 having a fuel cup reference line 972 extending from 0 degrees to 180 degrees and a transverse reference line 970 extending from 90 degrees to 270 degrees. The polar coordinate system 969 includes a first quadrant 974, a second quadrant 976, a third quadrant 978, and a fourth quadrant 980 The eighth dilution passage arrangement 900 includes a first line 916 and a second line 918.

The plurality of dilution passages 912, as in the fifth dilution passage arrangement 600, the sixth dilution passage arrangement 700, and the eighth dilution passage arrangement 800, terminate in a first group of slots 982 and a second group of slots 984. The first group of slots 982 can be formed the same as or different from the second group of slots 984. The eighth dilution passage arrangement 900 further includes a third line 991 and a fourth line 993 that interconnect circumferential ends of the first line 916 and the second line 918. With the first line 916, the second line 918, the third line 991 and the fourth line 993, a continuous polygonal path is formed spanning the entirety of a circumference of the fuel cup centerline 910. As a non-limiting example, the polygonal path can be rectangular. Alternatively, the polygonal path can be any sort of polygonal path including three or more interconnected lines.

The first line 916, the second line 918, the third line 991 and the fourth line 993 each extend through at least two quadrants. As a non-limiting example, the first line 916 extends between the second quadrant 976 and the third quadrant 978, the fourth line 993 extends from a portion of the first line 916 in the third quadrant 978 and to the fourth quadrant 980, the second line 918 extends from a portion of the fourth line 993 in the fourth quadrant 980 and to the first quadrant 974, and the third line 991 extends from a portion of the second line 918 in the first quadrant 974 and to a portion of the first line 916 in the second quadrant 976.

A set of corner slots 996 can be formed at the vertices between the first line 916, the second line 918, the third line 991 and the fourth line 993. The set of corner slots 996 can be formed within one of either the first group of slots 982 or the second group of slots 984. The set of corner slots 996 further denote a change from the first group of slots 982 to the second group of slots 984. In other words, the first line 916 and the second line 918 can include the first group of slots 982, while the third line 991 and the fourth line 993 can include the second group of slots 984. As such, the slots provided on the third line 991 and the fourth line 993 can have a different formation with respect to the slots formed on the first line 916 and the second line 918.

As a non-limiting example, the second groups of slots 984 can include the second passage angle (e.g., the second passage angle (θ) of FIG. 8) while the first group of slots 982 do not. As a non-limiting example, the second passage angle of the second group of slots 984 can decrease from the corner slot 996 provided on the first line 916 and to a central slot 994 and then increase from the central slot 994 and to an opposing corner slot 996 provided on the second line 918. The central slot 994 is defined as a slot that is radially closest a transition between quadrants (e.g., the transverse reference line 970) of the second group of slots 984 provided on the third line 991 or the fourth line 993. As a non-limiting example, an absolute value of the second passage angle can serially decrease in size from the first line 916 (e.g., the corner slot 996 on the first line 916) to the central slot 994, and then serially increase in size from the central slot 994 and to the corner slot 996 on the second line 918. As a non-limiting example, the corner slot 996 on the first line 916 can have second passage angle with an absolute value of 30 degrees, the central slot 994 can have a second passage angle of 0 degrees, and the corner slot 996 on the second line 918 can have a second passage angle with an absolute value of 30 degrees. This configuration, in other words, can ensure that each of the slots provided on the third line 991 and the fourth line 993 are pointing radially inward towards the fuel cup centerline 910. While described in terms of the second passage angle on the second of slots 984 being serially decreased and then increased, it will be appreciated that the same trend can be provided on the first group of slots 982 or any other group of slots.

As a non-limiting example, during operation both the first group of slots 982 and the second group of slots 984 can be fed a total volume of compressed air over a period of time (hereinafter referred to as a "volumetric flow rate"). The first group of slots 982 can include a first volumetric flow rate while the second group of slots 984 can include a second volumetric flow rate. The first volumetric flow rate can be non-equal to the second volumetric flow rate. As a non-limiting example, the first volumetric flow rate is larger than the second volumetric flow rate.

Benefits of the smaller cross-sectional area or the differing volumetric flow rates can result in the flame still being allowed to flow over the second group of slots 984 (e.g., over the third line 991 and the fourth line 993) and merge with a circumferentially adjacent vane. As such, the purpose of the first break (e.g., the first break 220 of FIG. 4) and the second break (e.g., the second break 222 of FIG. 4) is still achieved with the dilution passage arrangement 900. The difference, however, is that the eighth dilution passage arrangement 900 allows for additional shaping of the flame that flows between adjacent fuel cups 904. Specifically, the dilution passage arrangement 900 will push the flame axially away from the dome wall 902 so that it does not heat or otherwise contact the dome wall 902 between adjacent fuel cups 904.

Benefits of the second passage angles being included within at least one group of slots 982, 984 is for further flame shaping. For example, the serial increase and then decrease of the second passage angles can be used to ensure that the slots 982, 984 provide a compressed airflow that is pointed toward the fuel cup centerline 910. This, in turn, compresses or expands the swirled air/fuel mixture, respectively.

Figure 17:
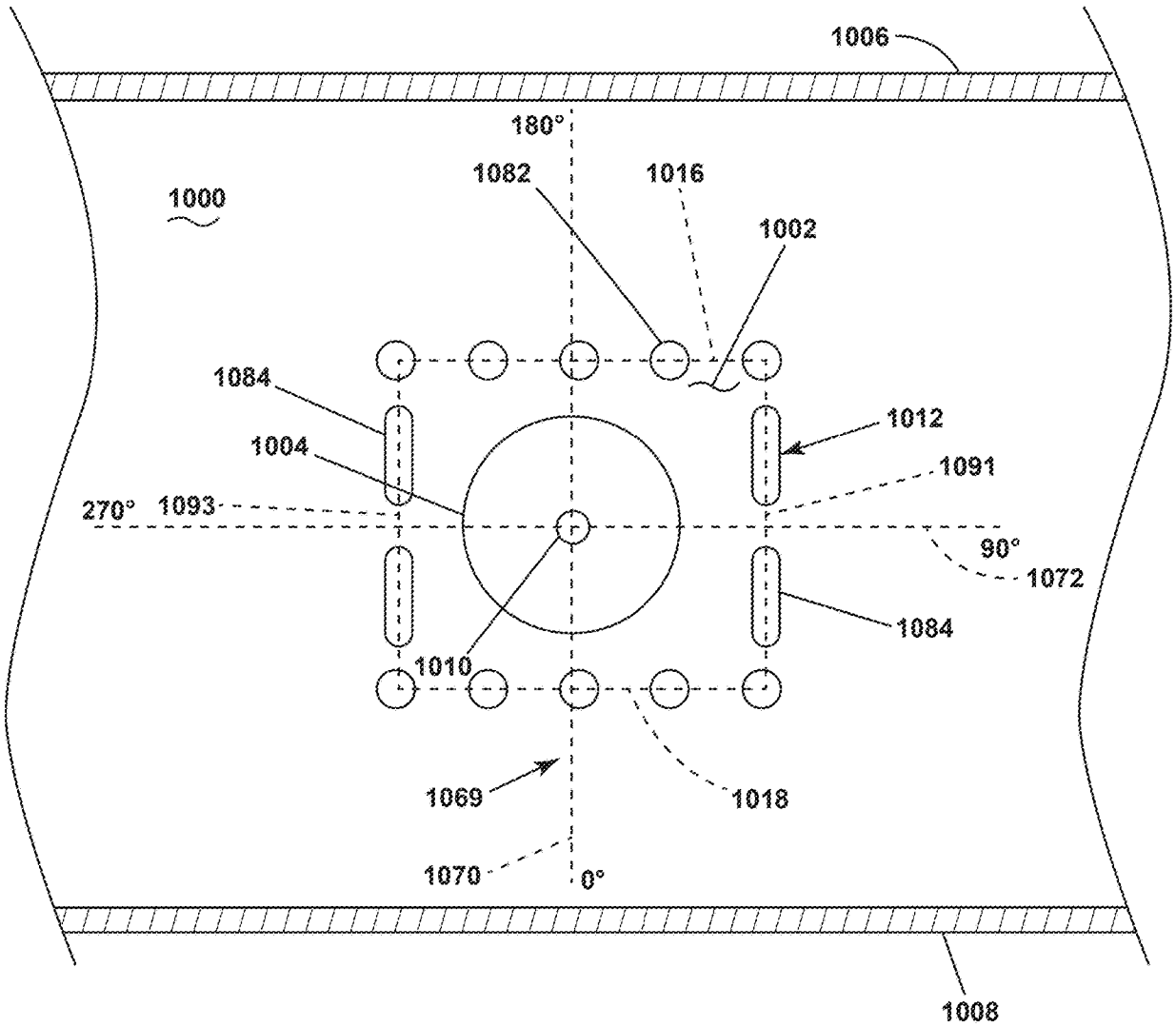
FIG. 17 is a schematic, transverse view of a ninth dilution passage arrangement suitable for use as the dilution passage arrangement of FIG. 4, the dilution passage arrangement including a first group of slots and a second group of slots arranged along a continuous line and having at least one oblong slot.

FIG. 17 is a schematic, transverse view of an exemplary ninth dilution passage arrangement 1000 suitable for use as the first dilution passage arrangement 200 of FIG. 4. The ninth dilution passage arrangement 1000 is similar to the dilution passage arrangement 200, 300 (FIG. 10), 400 (FIG. 11), 500 (FIG. 12), 600 (FIG. 13), 700 (FIG. 14), 800 (FIG. 15), 900 (FIG. 16), therefore, like parts will be identified by like numerals increased to the 1000 series, with it being understood that the description of the dilution passage arrangement 200, 300, 400, 500, 600, 700, 800, 900 applies to the eighth dilution passage arrangement 900, unless otherwise noted.

The ninth dilution passage arrangement 1000 is provided on a dome wall 1002 and surrounding a fuel cup 1004 having a fuel cup centerline 1010. The dome wall 1002 extends radially between an outer liner 1006 and an inner liner 1008. A plurality of dilution passages 1012 extend through the dome wall 1002. The ninth dilution passage arrangement 1000 is provided along a polar coordinate system 1069 having a fuel cup reference line 1072 extending from 0 degrees to 180 degrees and a transverse reference line 1070 extending from 90 degrees to 270 degrees.

The ninth dilution passage arrangement 1000 is most similar to the eighth dilution passage arrangement 900 in that it includes a plurality of dilution passages 1012 terminating in a first group of slots 1082 and a second group of slots 1084, with the first group of slots 1082 and the second group of slots 1084 being provided on at least one of a first line 1016, a second line 1018, a third line 1091, or a fourth line 1093. The difference, however, is that the second group of slots 1084 can be formed as oblong or otherwise non-circular slots.

Benefits of the present disclosure include a combustor suitable for use with a hydrogen-containing fuel. As outlined previously, hydrogen-containing fuels have a higher flame temperature than traditional fuels (e.g., fuels not containing hydrogen). That is, hydrogen or a hydrogen mixed fuel typically has a wider flammable range and a faster burning velocity than traditional fuels such petroleum-based fuels, or petroleum and synthetic fuel blends. These high burn temperatures of hydrogen-containing fuel mean that additional insulation is needed between the ignited hydrogen-containing fuel and surrounding components of the gas turbine engine (e.g., the dome wall, the inner/outer liner, and other parts of the gas turbine engine). The combustor, as described herein, includes the plurality of slots that create a layer of insulation (e.g., the curtain of compressed air) between the ignited hydrogen-containing fuel and the dome wall, the inner liner, the outer liner, and any portions of the gas turbine engine outside of the dome wall, the inner liner and the outer liner. The curtain of compressed air is further used to shape the flame within the combustion chamber, which in turn results in an enhanced control of the flame shape profile. By shaping the flame the liner wall temperature, the dome wall temperature, the combustor exit temperature profile and pattern of the flame/gas exiting the combustor can be controlled. This control or shaping can further ensure that the combustion section or otherwise hot sections of the turbine engine do not fail or otherwise become ineffective by being overly heated, thus increasing the lifespan of the turbine engine. Further, the introduction of the dilution passage arrangements, as described herein, ensure an even, uniform, or otherwise desired flame propagation within the combustor.

Benefits associated with using hydrogen-containing fuel over conventional fuels include an eco-friendlier engine as the hydrogen-containing fuel, when combusted, generates less carbon pollutants than a combustor using conventional fuels. For example, a combustor including 100% hydrogen-containing fuel (e.g., the fuel is 100% $H_2$) would have zero carbon pollutants. The combustor, as described herein, can be used in instances where 100% hydrogen-containing fuel is used.

Further benefits associated with using hydrogen-containing fuel over conventional fuels include a gas turbine engine that can utilize less fuel due to higher heating vale of fuel to achieve same turbine inlet temperatures. For example, a conventional gas turbine engine using conventional fuels will require less fuel to produce the same amount of work or engine output as the present gas turbine engine using hydrogen-containing fuels and having a more lean flame. This, in turn, means that either less amount of fuel can be used to generate the same amount of engine output as a conventional gas turbine engine, or the same amount of fuel can be used to generate an excess of increased engine output when compared to the conventional gas turbine engine.

To the extent not already described, the different features and structures of the various embodiments can be used in combination, or in substitution with each other as desired. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A combustor for a gas turbine engine, the combustor defining a combustor centerline and comprising a dome wall, an annular liner extending from the dome wall, a combustion chamber at least partially defined by the dome wall and the annular liner, a set of fuel cups circumferentially spaced along the dome wall relative to the combustor centerline, with each fuel cup having a fuel cup centerline, a set of dilution passages for each fuel cup of the set of fuel cups, with each dilution passage of the set of dilution passages having a passage centerline, and a plurality of slots spaced about a fuel cup in the set of fuel cups, with each slot of the plurality of slots defining a termination of at least one dilution passage of the set of dilution passages and including a center point defined as a location where the passage centerline of the at least one dilution passage intersects the slot, with the center points of the plurality of slots located on a polar coordinate system having a fuel cup reference line extending through the fuel cup centerline and defining a 0 degree to 180 degree reference line, with 0 degrees being radially closest to the combustor centerline, a transverse reference line defining a 90 degree to 270 degree reference line, a first quadrant extending between 0 degrees and 90 degrees, a second quadrant extending between 90 degrees and 180 degrees, a third quadrant extending between 180 degrees and 270 degrees, and a fourth quadrant extending between 270 degrees and 360 degrees, wherein at least a portion of the plurality of slots lay along a first line intersecting each center point of the plurality of slots.

A combustor defining a combustor centerline, the combustor comprising, a dome wall, an annular liner extending from the dome wall, a combustion chamber at least partially defined by the dome wall and the annular liner, a set of fuel cups circumferentially spaced along the dome wall relative to the combustor centerline, with each fuel cup having a fuel cup centerline, a set of dilution passages for each fuel cup of the set of fuel cups, with each dilution passage of the set of dilution passages having a passage centerline, and a plurality of slots spaced about a fuel cup in the set of fuel cups, with each slot of the plurality of slots defining a termination of at least one dilution passage of the set of dilution passages and including a center point defined as a location where the passage centerline of the at least one dilution passage intersects the slot, with the center points of the plurality of slots located on a polar coordinate system having a fuel cup reference line extending through the fuel cup centerline and defining a 0 degree to 180 degree reference line, with 0 degrees being radially closest to the combustor centerline, a transverse reference line defining a 90 degree to 270 degree reference line, a first quadrant extending between 0 degrees and 90 degrees, a second quadrant extending between 90 degrees and 180 degrees, a third quadrant extending between 180 degrees and 270 degrees, and a fourth quadrant extending between 270 degrees and 360 degrees, wherein at least a portion of the plurality of slots lay along a first line intersecting each center point of the plurality of slots.

The combustor of any preceding clause, wherein the first line includes a line angle with respect to the transverse reference line having an absolute value of greater than or equal to 0 degrees and less than or equal to 45 degrees.

The combustor of any preceding clause, wherein the first line includes a first leg and a second leg extending from a circumferential end of the first leg, wherein the second leg is non-parallel to the first leg.

The combustor of any preceding clause, wherein the second leg defines a curved line.

The combustor of any preceding clause, wherein the second leg extends at a leg angle with an absolute value of greater than 0 degrees and less than or equal to 80 degrees.

The combustor of any preceding clause, wherein each dilution passage of the set of dilution passages terminating in the plurality of slots include a first passage angle formed between the passage centerline and the fuel cup centerline, and a second passage angle formed between the passage centerline and the transverse reference line.

The combustor of any preceding clause, wherein the plurality of slots include a first group of slots provided on the first leg and having a first cross-sectional area, and a second group of slots provided on the second leg and having a second cross-sectional area, wherein the first group of slots and the second group of slots include at least one differing formation including at least one of a difference between the first cross-sectional area and the second cross-sectional area, a difference between the first passage angle of the first group of slots and the first passage angle of the second group of slots, or a difference between the second passage angle of the first group of slots and the second passage angle of the second group of slots.

The combustor of any preceding clause, wherein the first line further includes a third leg extending from a circumferentially opposite end of the first leg from where the second leg extends from.

The combustor of any preceding clause, wherein the second leg is a linear leg and the third leg is a curved leg.

The combustor of any preceding clause, further comprising a second line separate from the first line and including a respective subset of the plurality of slots.

The combustor of any preceding clause, wherein the second line is symmetric or non-symmetric about at least one of the transverse reference line or the fuel cup reference line with respect to the first line.

The combustor of any preceding clause, wherein the first line includes a series of non-parallel legs that form an undulating pattern.

The combustor of any preceding clause, wherein each slot of the plurality of slots includes an equal cross-sectional area.

The combustor of any preceding clause, wherein the cross-sectional area is in the form of an oblong, oval, or rectangular shape that has a major body axis larger than a minor body axis.

The combustor of any preceding clause, wherein the undulating pattern forms a series of inverse V's and right-side up V's, with inverse V's and right-side up V's partially bounding an interior, and a plurality of additional slots are located within the interiors.

The combustor of any preceding clause, wherein each of the dilution passages of the first line include a first passage angle formed between the passage centerline and the corresponding fuel cup centerline, and a second passage angle formed between the passage centerline and the transverse reference line.

The combustor of any preceding clause, wherein at least one of the second passage angle or the first passage angle of at least one slot of the plurality of slots is non-equal to the second passage angle or first passage angle, respectively, of an other slot of the plurality of slots.

The combustor of any preceding clause, wherein the plurality of slots include a first slot, and a second slot provided circumferentially closer to the fuel cup reference line than the first slot, with the second slot having a second passage angle with an absolute value smaller than an absolute value of the second passage angle of the first slot.

The combustor of any preceding clause, wherein the plurality of slots follow the first line and a second line, separate from the first line.

The combustor of any preceding clause, wherein the second line extends from the first line and over the transverse the reference line.

The combustor of any preceding clause, wherein the second line extends at a 90 degree angle from the first line.

The combustor of any preceding clause, wherein the plurality of slots include a first group of slots provided on the first line, a second group of slots provided on the second line, a corner slot defining a transition between the first group of slots and the second group of slots, and a central slot provided circumferentially nearest the transverse reference line, with a second passage angle of the dilution passages terminating in the second group of slots serially decreasing from the corner slot to the central slot.

The combustor of any preceding clause, wherein the second passage angle of the central slot is 0 degrees.

The combustor of any preceding clause, wherein the second passage angle of the dilution passages terminating at the second group of slots serially increases from the central slot to a distal slot provided circumferentially farthest from the first line, with respect to the fuel cup centerline.

The combustor of any preceding clause, wherein each slot of the plurality of slots includes an equal or non-equal cross-sectional area.

The combustor of any preceding clause, wherein the cross-sectional area of the first group of slots is non-equal to the cross-sectional area of the second group of slots.

The combustor of any preceding clause, wherein the cross-sectional area of the first group of slots forms a non-oblong shape and the cross-sectional area of the second group of slots form an oblong shape.

The combustor of any preceding clause, wherein the plurality of slots further extend along a third line and a fourth line, with the third line and the fourth line being symmetrical about the fuel cup reference line and the transverse reference line, with respect to the first line and the second line.

The combustor of any preceding clause, wherein the first line, the second line, the third line, and the fourth line form a continuous polygonal path about the fuel cup centerline.

The combustor of any preceding clause, wherein the plurality of slots include a radially closest slot to the fuel cup centerline, with the first line diverging outwardly from the radially closest slot with respect to the fuel cup centerline.

The combustor of any preceding clause, wherein the plurality of slots further extend along a second line, radially opposing the first line with respect to the fuel cup centerline.

The combustor of any preceding clause, wherein the first line and the second line are symmetrical about a transverse reference line.

The combustor of any preceding clause, wherein a fuel/air mixture is fed to the combustion chamber, through the set of fuel cups, with a portion of the fuel/air mixture being fed through a corresponding fuel cup of the set of fuel cups at a fuel/air volumetric flow rate, and a compressed air is fed to the combustion chamber through the corresponding set of dilution passages at a compressed air volumetric flow rate, with a ratio between the fuel/air volumetric flow rate and the compressed air volumetric flow rate being greater than or equal to 0.2 and less than or equal to 4.

The combustor of claim 1, wherein each dilution passage of the set of dilution passages includes a total axial length between an inlet of the dilution passage and a respective slot, the respective slot includes a slot width when viewed along a vertical plane perpendicular to the corresponding fuel cup centerline and intersecting the respective slot, and with a ratio between the total axial length and the slot width being greater than or equal to 0.1 and less than or equal to 10.

The combustor of any preceding clause, wherein the center point of each slot of the plurality of slots is provided a first radial distance from the fuel cup centerline, each fuel cup of the set of fuel cups includes an outlet formed along the dome wall, with an outer surface of the outlet being provided a second radial distance from the fuel cup centerline; and a ratio between the first radial distance and the second radial distance is greater than 1 and less than or equal to 3.

The combustor of any preceding clause, wherein each slot of the plurality of slots is defined by a slot width, each fuel cup of the set of fuel cups includes an outlet formed along the dome wall, the outlet having an outlet width, and a ratio between the slot width and the outlet width is greater than or equal to 0.03 and less than or equal to 0.5.

The combustor of any preceding clause, wherein each fuel cup receives a flow of fuel including a hydrogen fuel.

The combustor of any preceding clause, wherein opposing slot-free segments are defined between +/−75 degrees from a 90 degree and a 270 degree lines, and opposing slot-present segments are located between the slot-free segments, with the slots being located in the slot-present segments and not present in the slot-free segments.

What is claimed is:

1. A combustor for a gas turbine engine, the combustor defining a combustor centerline and comprising:

a dome wall;

an annular liner extending from the dome wall;

a combustion chamber at least partially defined by the dome wall and the annular liner;

a fuel cup provided along the dome wall relative to the combustor centerline, the fuel cup having a fuel cup centerline, the fuel cup opening to the combustion chamber at a fuel cup outlet, the fuel cup outlet having a first maximum width in a first plane that is perpendicular to the fuel cup centerline and intersecting the fuel cup outlet; and a single set of dilution passages, with each dilution passage of the set of dilution passages opening into the combustion chamber through at least one respective slot of a plurality of slots provided along the dome wall, each dilution passage of the set of dilution passages having a respective passage centerline, with each slot of the plurality of slots having a second maximum width in a second plane that is perpendicular to the passage centerline of the respective dilution passage of the set of dilution passages that opens into the combustion chamber at the respective slot of the plurality of slots and that intersects the respective slot;

wherein:

the plurality of slots includes a radially inner set of slots defined as a subset of slots of the plurality of slots without additional slots of the plurality of slots provided radially between the radially inner set of slots and the fuel cup, wherein every slot in the radially inner set of slots does not have an intervening slot located radially between the respective slot and the fuel cup;

a first subset of slots of the radially inner set of slots, each slot of the first subset of slots including a respective center point provided on a first line, the first subset of slots including:

a first set of three slots of the plurality of slots distributed along a first linear leg of the first line;

a second set of three slots of the plurality of slots distributed along a second curved leg of the first line that extends from a first end of the first linear leg of the first line; and a third set of three slots of the plurality of slots distributed along a third linear leg of the first line that extends from a second end of the first linear leg of the first line;

wherein a ratio between the second maximum width of a single slot of the plurality of slots and the first maximum width is greater than or equal to 0.03 and less than or equal to 0.5.

2. A combustor for a gas turbine engine, the combustor defining a combustor centerline and comprising:

a dome wall;

an annular liner extending from the dome wall;

a combustion chamber at least partially defined by the dome wall and the annular liner;

a fuel cup provided along the dome wall relative to the combustor centerline, the fuel cup having a fuel cup centerline and a fuel cup outlet opening to the combustion chamber; and a set of dilution passages, with each dilution passage of the set of dilution passages opening into the combustion chamber through at least one respective slot of a plurality of slots provided along the dome wall, each dilution passage of the set of dilution passages having a passage centerline, wherein each slot of the plurality of slots includes a center point defined by a location along the respective slot where the passage centerline of the respective dilution passage of the set of dilution passages that opens into the combustion chamber at the respective slot intersects the respective slot, with the respective center point of each slot of the plurality of slots forming a plurality of center points, the plurality of center points being located on a polar coordinate system having:

a fuel cup reference line extending through the fuel cup centerline and defining a 0 degree to 180 degree reference line, with 0 degrees being radially closest to the combustor centerline;

a transverse reference line defining a 90 degree to 270 degree reference line; and four quadrants split by the fuel cup reference line and the transverse reference line, the four quadrants including a first quadrant adjacent a second quadrant;

wherein:

the plurality of slots includes a radially inner set of slots defined as a subset of slots of the plurality of slots without additional slots of the plurality of slots provided radially between the radially inner set of slots and the fuel cup, wherein every slot in the radially inner set of slots does not have an intervening slot located radially between the respective slot and the fuel cup;

a first subset of slots of the radially inner set of slots, the respective center point of each slot of the first subset of slots provided on a first line, the first subset of slots including:

a first set of three slots of the plurality of slots distributed along a first linear leg of the first line, wherein the first set of three slots of the first subset of slots is located in the first quadrant and the second quadrant;

a second set of three slots of the plurality of slots distributed along a second curved leg of the first line that extends from a first end of the first linear leg of the first line, wherein the second set of three slots of the first subset of slots is located in the first quadrant; and a third set of three slots of the plurality of slots distributed along a third linear leg of the first line that extends from a second end of the first linear leg of the first line, wherein the third set of three slots of the first subset of slots is located in the second quadrant;

the first line extending circumferentially about a portion of the fuel cup with respect to the fuel cup centerline.

3. The combustor of claim 2, wherein the first quadrant is separated from the second quadrant via the fuel cup reference line.

4. The combustor of claim 2, wherein the third linear leg of the first line is non-parallel to the first linear leg of the first line, and wherein the second curved leg of the first line extends toward transverse reference line.

5. The combustor of claim 4, wherein the third linear leg of the first line extends at a leg angle relative to the transverse reference line with an absolute value of greater than 0 degrees and less than or equal to 80 degrees.

6. The combustor of claim 4, wherein:

each dilution passage of the set of dilution passages terminating in the plurality of slots includes:

a first passage angle formed between the passage centerline and a projection of the fuel cup centerline intersecting the passage centerline; and a second passage angle formed between the passage centerline and a projection of the transverse reference line intersecting the passage centerline;

the plurality of slots include:

the first set of three slots of the plurality of slots on the first linear leg of the first line having a respective first cross-sectional area; and the second set of three slots of the plurality of slots on the second curved leg of the first line having a respective second cross-sectional area; and the first set of three slots and the second set of three slots include at least one differing formation including at least one of a difference between the respective first cross-sectional area and the respective second cross-sectional area, a difference between the first passage angle of the first set of three slots on the first line and the first passage angle of the second set of three slots on the first line, or a difference between the second passage angle of the first set of three slots on the first line and the second passage angle of the second set of three slots on the first line.

7. The combustor of claim 4, wherein one slot of the first set of three slots of the plurality of slots that extend along the first linear leg of the first line is located entirely in the first quadrant.

8. The combustor of claim 7, wherein two slots of the first set of three slots of the plurality of slots that extend along the first linear leg of the first line are located entirely in the second-quadrant.

9. The combustor of claim 4, wherein: the four quadrants include a third quadrant adjacent a fourth quadrant, wherein the third quadrant is located adjacent to the first quadrant; and a second subset of slots of the radially inner set of slots, the respective center point of each slot of the second subset of slots provided along a second line, the second subset of slots including:

a first set of three slots of the plurality of slots distributed along a first linear leg of the second line, wherein the first set of three slots of the second subset of slots is located in the third quadrant and the fourth quadrant;

a second set of three slots of the plurality of slots distributed along a second linear leg of the second line that extends from a first end of the first linear leg of the second line, wherein the second set of three slots of the second subset of slots is located in the third quadrant; and a third set of three slots of the plurality of slots distributed along a third curved leg of the second line that extends from a second end of the first linear leg of the second line, wherein the third set of three slots of the second subset of slots is located in the fourth quadrant;

the second line extending circumferentially about a portion of the fuel cup with respect to the fuel cup centerline.

10. The combustor of claim 9, wherein the second linear leg of the second line is non-parallel to the first linear leg of the second line, and wherein the third curved leg of the second line extends toward transverse reference line.

11. The combustor of claim 10, wherein the second linear leg of the second line extends at a leg angle relative to the transverse reference line with an absolute value of greater than 0 degrees and less than or equal to 80 degrees.

12. The combustor of claim 9, wherein one slot of the first set of three slots of the second line is located entirely in the third quadrant.

13. The combustor of claim 12, wherein two slots of the first set of three slots of the the second line are located entirely in the fourth quadrant.

14. The combustor of claim 9, wherein the first line and the second line are non-symmetric relative to one another about the transverse reference line.

15. The combustor of claim 2, wherein each fuel cup receives a flow of fuel including a hydrogen fuel.

16. The combustor of claim 2, wherein:

each dilution passage of the set of dilution passages includes a total axial length between an inlet of the dilution passage and a respective slot;

the respective slot is defined by a slot width; and with a ratio between the total axial length and the slot width being greater than or equal to 0.1 and less than or equal to 10.

17. The combustor of claim 2, wherein each dilution passage of the set of dilution passages includes:

a first passage angle formed between the passage centerline and a projection of the fuel cup centerline intersecting the passage centerline; and a second passage angle formed between the passage centerline and a projection of the transverse reference line intersecting the passage centerline, with at least one dilution passage of the set of dilution passages including a second passage angle greater than 0 degrees.

* * * * *